US007770528B2

(12) United States Patent
Okazaki et al.

(10) Patent No.: US 7,770,528 B2
(45) Date of Patent: Aug. 10, 2010

(54) SOLID FUEL BURNER, SOLID FUEL BURNER COMBUSTION METHOD, COMBUSTION APPARATUS AND COMBUSTION APPARATUS OPERATION METHOD

(75) Inventors: Hirofumi Okazaki, Hitachinaka (JP); Kenji Yamamoto, Hitachinaka (JP); Kenji Kiyama, Kure (JP); Kouji Kuramashi, Kure (JP)

(73) Assignee: Babcock- Hitachi K.K., Tokyo (JP)

( * ) Notice: Subject to any disclaimer, the term of this patent is extended or adjusted under 35 U.S.C. 154(b) by 0 days.

(21) Appl. No.: 11/566,425

(22) Filed: Dec. 4, 2006

(65) Prior Publication Data

US 2007/0092847 A1 Apr. 26, 2007

Related U.S. Application Data

(63) Continuation of application No. 10/983,901, filed on Nov. 9, 2004, now Pat. No. 7,213,522.

(30) Foreign Application Priority Data

Nov. 10, 2003 (JP) ..... 2003/379898

(51) Int. Cl.
*F23D 1/00* (2006.01)

(52) U.S. Cl. ..... 110/264; 110/265

(58) Field of Classification Search ..... 239/421, 239/424.5, 426, 423; 431/8–10, 187, 188; 110/264, 265, 347, 348, 297
See application file for complete search history.

(56) References Cited

U.S. PATENT DOCUMENTS 3,033,273 A * 5/1962 Zink, Jr. et al. ..... 431/174

(Continued)

FOREIGN PATENT DOCUMENTS

EP 0529779 A2 3/1993

(Continued)

OTHER PUBLICATIONS

European search report dated Jul. 25, 2008.

*Primary Examiner*—Kenneth B Rinehart
(74) *Attorney, Agent, or Firm*—Crowell & Moring LLP

(57) ABSTRACT

A solid fuel burner and its combustion method suited for encouraging fuel ignition and avoiding slugging caused by combustion ash, wherein a gas of low oxygen concentration (exhaust combustion gas) is used as a carrier gas of such a low grade solid fuel as brown coal. An additional air nozzle for jetting additional air having a velocity component in the circumferential direction of a fuel nozzle is provided in the fuel nozzle, thereby encouraging mixing between the fuel and air in the fuel nozzle. Further, the amount of air supplied from the additional air nozzle is adjusted in response to the difference in combustion loads. Under light load, the amount of air supplied from the additional air nozzle is increased so as to increase the oxygen concentration of the circulating flow formed downstream of the outside of the outlet of the fuel nozzle, whereby stable combustion is ensured. Under heavy load, by contrast, the amount of air supplied from the additional air nozzle is decreased, and a flame is formed away from the fuel nozzle in such a way that burner structures and furnace wall will be less subjected to radiant heat.

19 Claims, 12 Drawing Sheets

U.S. PATENT DOCUMENTS

| | | | | |
|---|---|---|---|---|
| 4,688,496 | A * | 8/1987 | Schreter | 110/264 |
| 4,702,180 | A | 10/1987 | Kiga | 110/263 |
| 5,199,355 | A | 4/1993 | Larue | |
| 6,237,510 | B1 * | 5/2001 | Tsumura et al. | 110/262 |
| 6,238,457 | B1 | 5/2001 | Holmi et al. | |
| 6,715,432 | B2 | 4/2004 | Tsumura et al. | |
| 2002/0144636 | A1 | 10/2002 | Tsumura et al. | |

FOREIGN PATENT DOCUMENTS

| | | | |
|---|---|---|---|
| EP | 0852315 | A1 | 7/1998 |
| EP | 1306614 | A1 | 5/2003 |
| EP | 1312859 | A1 | 5/2003 |
| GB | 309641 | | 4/1929 |
| JP | 61-69608 | U | 5/1986 |
| JP | 2003-240227 | | 8/2003 |
| WO | WO 02/12791 | A1 | 2/2002 |

* cited by examiner

SOLID FUEL BURNER, SOLID FUEL BURNER COMBUSTION METHOD, COMBUSTION APPARATUS AND COMBUSTION APPARATUS OPERATION METHOD

This application is a continuation of U.S. patent application Ser. No. 10/983,901, filed Nov. 9, 2004, the entire disclosure of which is incorporated herein by reference, which, in turn, claims the priority of Japanese Patent application 2003/379898, filed Nov. 10, 2003.

BACKGROUND OF THE INVENTION

1. Technical Field of the Invention

The present invention relates to a solid fuel burner for burning a solid fuel fed by gas flow, particularly to a solid fuel burner, a solid fuel burner combustion method, a combustion apparatus (combustion apparatus) equipped with solid fuel burners and an operation method of the combustion apparatus, suitable for suspended combustion of such fuels as wood, peat and coal, containing much water and volatile matter by pulverizing and feeding them by gas.

2. Description of Prior Art

Since fuel such as wood, peat and coal having a low coalification rank, represented by brown coal and lignite, contains much volatile matter, in the atmosphere of air, such a fuel tends to undergo spontaneous ignition in the process of storage, pulverization and feed, and is not easy to handle, as compared to the bituminous coal. To prevent spontaneous ignition, when such a fuel is pulverized and burnt, the gas mixture of air and exhaust combustion gas with oxygen concentration reduced may be used as a gas for carrying the fuel. The exhaust combustion gas serves to reduce the oxygen concentration around the fuel and to control the oxidation reaction (combustion) of the fuel, thereby avoiding spontaneous ignition. Further, the exhaust combustion gas also serves to remove water content in the fuel by the potential heat.

However, when the fuel carried by the carrier gas is jetted from the solid fuel burner, the oxidation reaction of this fuel is restricted by the oxygen concentration around the fuel, and the combustion speed is low as compared to the cases where the fuel is carried by air. Normally, after having mixed with the air jetted from the air nozzle, the fuel is subjected to active oxidation reaction. Therefore, combustion speed is determined by the speed of mixing with air. Thus, fuel switching time is longer than that when the fuel is carried by air. This will lead to increase in the amount of the unburnt fuel at the outlet of the combustion apparatus, i.e. the furnace.

Further, flame temperature is low since combustion is slow. This makes it difficult to utilize the reduction reaction of the nitrogen oxides (NOx) into nitrogen, which becomes active in a reducing atmosphere of high temperature (about 1000° C. or higher). The NOx at the outlet of the furnace tends to be greater in amount than when the fuel is carried by air.

One of the ways to expedite the ignition of the fuel carried by the carrier gas is to increase the oxygen concentration of the fuel carrier gas in the vicinity of the fuel nozzle outlet. For example, proposed is a structure for installation of an additional air nozzle outside the fuel nozzle or at the center of the nozzle. The additional air nozzle promotes mixing of the fuel with air at the fuel nozzle outlet.

If the air from the additional air nozzle is jetted in the form of fuel jet, viz., in parallel to the fuel and its carrier gas as in the case of the aforementioned prior art examples, mixing between the fuel jet and additional air will be slow because there is a small difference in flow velocity between the fuel jet and the air jet from the additional air nozzle.

Normally, the distance from the additional air nozzle outlet to the fuel nozzle outlet is 1 meter or less. Since the velocity of the fuel jet is about 12 meters per second or higher, time of mixing between the fuel particle and additional air in the fuel nozzle is as short as about 0.1 second or less. If the additional air is jetted in parallel to the fuel particle, mixing will be insufficient.

In the meantime, when the additional air nozzle is arranged upstream of the fuel nozzle in order to prolong the time of mixing between the fuel particle and additional air in the fuel nozzle, so-called a back fire may occur, wherein the fuel is fired inside the fuel nozzle if the oxygen concentration is increased. Thus, the distance from the additional air nozzle outlet to the fuel nozzle outlet cannot be increased.

To solve such problems, the present inventors have proposed a structure wherein an additional air nozzle is arranged in the fuel nozzle, and air is jetted from the additional air nozzle in the direction almost perpendicular to the fuel jet running through the fuel nozzle. In another structure proposed by the same present inventors, an additional air nozzle and a separator that separates the flow path are arranged in the fuel nozzle, and the outlet of the additional air nozzle overlaps with the separator, when viewed from the direction perpendicular to the burner shaft. (See Patent Document 1, for example).

Patent Document 1: Japanese Application Patent Laid-open Publications No. 2003-240227 (JP 2003-240227 A) (FIGS. 1 through 4 on pp. 7 through 9.)

SUMMARY OF THE INVENTION

Problems to be Solved by the Invention

However, as described in Patent Document 1, when the additional air nozzle is arranged on the partition of the outer periphery of the fuel nozzle and air is jetted in the direction almost perpendicular to the fuel jet, viz., in the radial direction of the nozzle, the oxygen concentration is relatively lower in the portion devoid of additional air nozzle, although oxygen concentration will be increased in the downstream portion of the additional air nozzle. As a result, in the fuel nozzle outlet, the portion of high oxygen concentration and the portion of low oxygen concentration will be formed in the circumferential direction. To ensure uniform distribution of the oxygen concentration, the number of the additional air nozzles must be increased, which will lead to higher production costs.

When the additional air nozzle is arranged on the partition of the outer periphery of the fuel nozzle, the opening of the additional air nozzle outlet becomes parallel to the fuel jet. This will make it more likely for fuel particles to collide with the opening of the additional air nozzle outlet. This will create the possibility of causing wear of the additional air nozzle and the counter flow of the fuel particle.

An object of the present invention is to provide a solid fuel burner that uses a gas of low oxygen concentration as a carrier gas of the low-quality solid fuel such as brown coal, wherein mixing between the fuel particle and air in the fuel nozzle is encouraged over a wide range from a light load to a heavy load, without changing the distance from the additional air nozzle outlet to the fuel nozzle outlet, and the fuel concentration and oxygen concentration in the fuel nozzle provides a range where these values are higher than the average values in the fuel nozzle, thereby ensuring stable combustion, a combustion method for the solid fuel burner equipped with a means for ensuring stable combustion by encouraging mixture between fuel particles and air, a combustion apparatus equipped with the solid fuel burners, and an operation method of the combustion apparatus.

To achieve the aforementioned object, the present invention provides a solid fuel burner comprising a fuel nozzle for jetting a fluid mixture of a solid fuel and its carrier gas, and at least one air nozzle, arranged outside the fuel nozzle, for jetting air, wherein at least one additional air nozzle for jetting additional air having a velocity component in the circumferential direction of the fuel nozzle is provided in such a way as to project into the aforementioned fuel nozzle.

According to the present invention, there can be provided a solid fuel burner that ensures stable combustion of even the solid fuel, such as a coal having a low coalification rank represented by brown coal and lignite, characterized by lower combustibility, wherein mixing between the fuel particle and air in the fuel nozzle is encouraged over a wide range from a light load to a heavy load, without changing the distance from the additional air nozzle outlet to the fuel nozzle outlet, the aforementioned solid fuel burner being equipped with a means for avoiding slugging caused by combustion ash, a combustion method for the solid fuel burner, a combustion apparatus equipped with the solid fuel burners, an operation method of the combustion apparatus, and a coal-fired boiler.

DESCRIPTION OF REFERENCE NUMERALS

Figure 1:
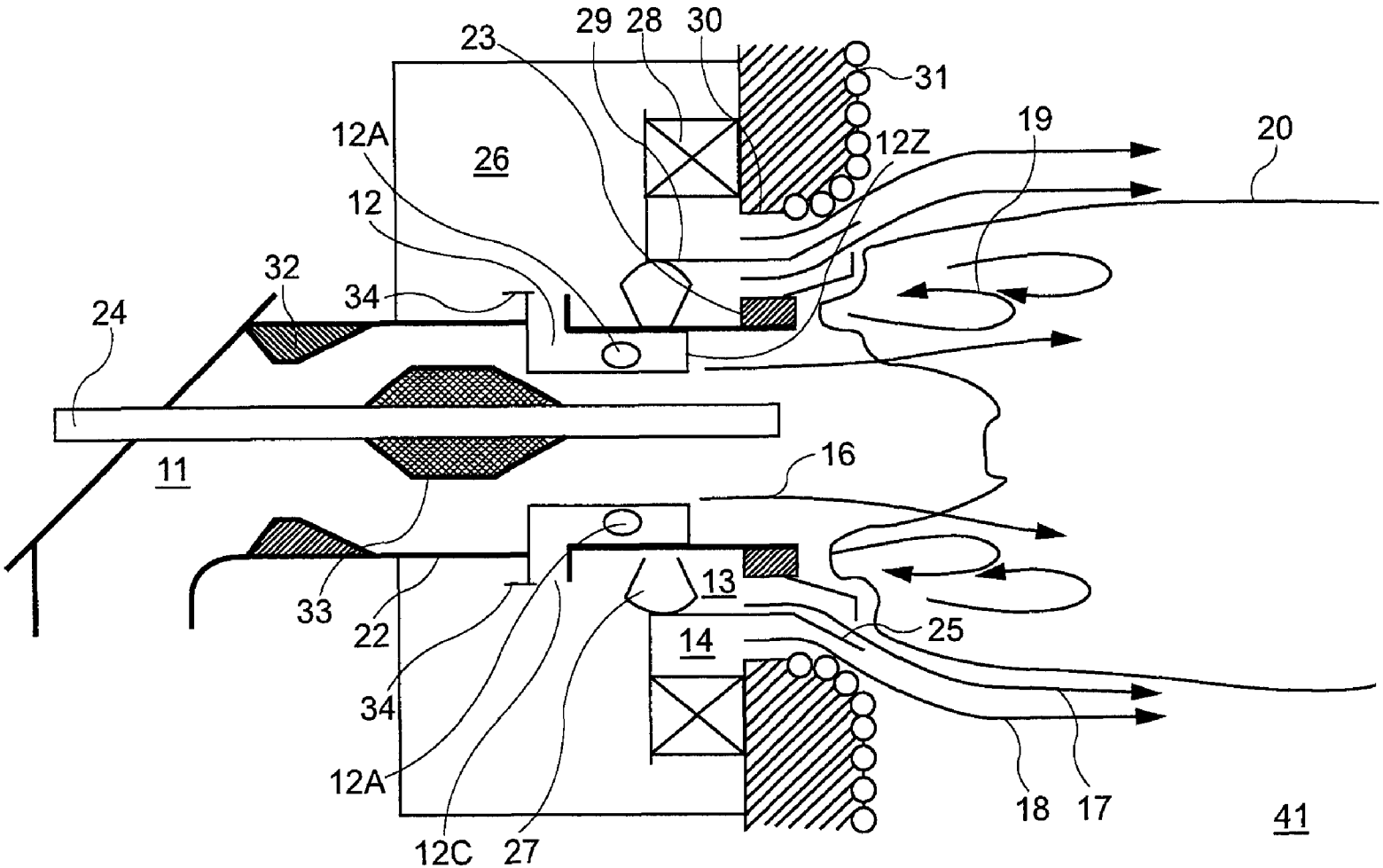
FIG. 1 is a sectional view showing the configuration of a first embodiment of the solid fuel burner according to the present invention, wherein a flame of the solid fuel burner is formed from the circulating flow downstream of a flame holder when the solid fuel burner is used under light load.

11: Fuel nozzle, 12: Additional air nozzle, 13: Outside air nozzle (secondary air nozzle), 14: Outside air nozzle (tertiary air nozzle), 16: Fuel and its carrier gas flow (fuel jet), 17: Secondary air flow, 18: Tertiary air flow, 19: Circulating flow, 20: Flame profile, 21: Additional air jet, 22: Fuel nozzle outside partition, 23: Obstacle (flame holder), 24: Oil gun, 25: Guide, 26: Air box, 27: Swirler, 28: Swirler, 29: Partition, 30: Burner throat, 31: Water pipe, 32: Flow path reducing member (venturi), 33: Obstacle (concentrator), 34: Flow control valve, 35: Separator, 36: Flow path on the opposite side, 37: Flow path on the air nozzle side, 38: Inside air nozzle, 41: Furnace, 42: Solid fuel burner, 43: Fuel hopper, 44: Coal feeder, 45: Pulverizer, 46: Blower, 47: Flame detector under light load, 48: Flame detector under heavy load, 49: After-air port, 54: Toothed flame holder, 55: Exhaust combustion gas pipe, 56: Fuel pipe, 57: Fuel hopper, 58: Exhaust combustion gas outlet, 59: Exhaust combustion gas inlet.

DESCRIPTION OF EMBODIMENTS OF THE INVENTION

The additional air nozzle has a configuration to smoothly reduce and extend the sectional area of the flow path of the fluid mixture flowing through the aforementioned fuel nozzle, and a jet or outlet formed on the side thereof for jetting the air having a velocity component in the direction perpendicular to the fluid mixture.

It is also possible to make such arrangement that the additional air nozzle has a configuration to smoothly reduce and extend the sectional area of the flow path of the fluid mixture flowing through the aforementioned fuel nozzle, a jet or outlet formed on the side thereof for jetting the air having a velocity component in the direction perpendicular to the fluid mixture, and a jet or outlet formed on the downstream end for jetting the air having a velocity component in the direction parallel to the fluid mixture flowing through the fuel nozzle.

It is also possible to arrange such a configuration that a venturi configured to smoothly reduce and extend the sectional area of the flow path of the aforementioned fuel nozzle from the outer periphery, and a concentrator configured to smoothly reduce and extend the sectional area of the flow path of the aforementioned fuel nozzle from the inside are arranged upstream of the aforementioned additional air nozzle.

Such an arrangement can be made that the aforementioned fuel nozzle incorporates therein a separator for dividing the flow path, and the outlet of the additional air nozzle overlaps with the separator, when viewed in the direction perpendicular to the burner shaft.

It is also possible to arrange such a configuration that a venturi configured to smoothly reduce and extend the sectional area of the flow path of the aforementioned fuel nozzle from the outer periphery and a concentrator configured to smoothly reduce and extend the sectional area of the flow path of the aforementioned fuel nozzle from the inside are provided upstream of the aforementioned additional air nozzle, the aforementioned fuel nozzle incorporates therein a separator for dividing the flow path, and the outlet of the aforementioned additional air nozzle overlaps with the aforementioned separator when viewed in the direction perpendicular to the burner shaft.

In this case, arrangements are made in such a way that, of the fuel nozzle flow paths divided by the separator, the sectional area of the flow path on the side where the additional air nozzle is mounted on the tip end upstream of the separator has an area greater than that of the flow path reduced by the concentrator.

It is also possible to make such arrangements that a concentrator configured to smoothly reduce and extend the sectional area of the flow path of the fuel nozzle from the inside are provided upstream of the additional air nozzle, the fuel nozzle incorporates therein a separator for dividing the flow path, and the outlet of the additional air nozzle overlaps with the separator, when viewed in the direction perpendicular to the burner shaft.

Arrangements can be made in such a way that a flame holder or stabilizer for discouraging the flow of the solid fuel jetting from the fuel nozzle and the carrier gas thereof, and the flow of the air jetting from the air nozzle is provided on the tip end of the partition separating between the fuel nozzle and air nozzle.

Arrangements can also be made in such a way that a toothed flame holder for discouraging the flow of the solid fuel jetting from the fuel nozzle and the carrier gas thereof, and the flow of the air jetting from the air nozzle is provided on the tip end of the partition separating between the fuel nozzle and air nozzle.

If the fuel nozzle outlet is provided with a toothed flame holder for discouraging the fuel jet, the fuel jet will be more disturbed by the flame holder and the fuel is mixed with air, with the result that combustion reaction is promoted and fuel ignition is encouraged.

In the combustion method for the solid fuel burner according to the present invention, the amount of air supplied from the additional air nozzle is increased when combustion load is low, while the amount of air supplied from the additional air nozzle is decreased when combustion load is high.

Further, the amount of air supplied from the additional air nozzle is increased when combustion load is low, and the amount of air supplied from the innermost air nozzle out of the air nozzles is decreased or the swirling flow velocity is increased, whereas the amount of air supplied from the additional air nozzle is decreased when combustion load is high, and the amount of air supplied from the innermost air nozzle out of the air nozzles is increased or the swirling flow velocity is decreased.

The present invention proposes a combustion apparatus comprising a furnace provided with a plurality of any one of the aforementioned solid fuel burners, a fuel hopper, a coal feeder, a pulverizer for introducing the fuel mixed with the exhaust combustion gas extracted from the top of the combustion apparatus in the exhaust combustion gas pipe downstream of the coal feeder, a fuel pipe for feeding the fuel pulverized by the pulverizer, to the solid fuel burner, a blower for feeding air to the solid fuel burner, a light load flame detector, a thermometer or a radiant intensity meter for monitoring the flame formed for each solid fuel burner under light load, a light load flame detector, a thermometer or a radiant intensity meter for monitoring the flame formed away from the solid fuel burner under heavy lead, and control means for controlling the amount of air jetted from the additional air nozzle, based on signals from the measuring instrument.

The flame of a solid fuel is formed away from the solid fuel burner, when the combustion apparatus is operated under a high fuel load, and the flame of a solid fuel is formed from a place immediately downstream of the fuel nozzle outlet of the solid fuel burner, when the combustion apparatus is operated under a low combustion load.

The solid fuel burner of the present invention provides a solid fuel burner particularly suitable the case where the oxygen concentration of the fuel carrier gas is less than 21%, when suspended combustion of such solid fuels as coal, wood and peat containing much water and volatile matter is effected by pulverizing and carrying them through carrier gas.

The solid fuel burner of the present invention comprises a fuel nozzle for jetting a fluid mixture of a solid fuel and its carrier gas, at least one air nozzle, arranged outside the fuel nozzle, for jetting air, and an additional air nozzle for jetting air having almost perpendicular to the flow of the fluid mixture in the fuel nozzle, the additional air nozzle having a plurality of nozzle outlets, at least one of which is arranged in the circumferential direction of the fuel nozzle.

The additional air nozzle is exposed in the fuel nozzle to reduce the sectional area of the flow path. From the viewpoint of avoiding wear of the additional air nozzle outlet and counter flow of the fuel particle, the additional air nozzle outlet is preferably arranged at a position where the sectional area of the flow path is extended.

At least one of the additional air nozzles has a nozzle outlet in the circumferential direction of the fuel nozzle. The air jetted from this nozzle outlet has a velocity component in the circumferential direction of the fuel nozzle, and is jetted almost perpendicular to the fuel jet running through the fuel nozzle. Thus, the difference in the speed between the fuel particle and additional air nozzle jet is greater than that when air is jetted in the parallel direction, with the result that mixing goes on smoothly. Especially the fuel particle has a greater density than gas; therefore, it is mixed into the additional air nozzle jet due to inertia.

Additional air is jetted in the circumferential direction of the fuel nozzle. Mixing of air in the circumferential direction is more effective than when air is jetted in the radial or axial direction. Accordingly, if the additional air nozzle is arranged on the outer periphery of the fuel nozzle, air is mixed uniformly on the outer periphery, using a smaller number of additional air nozzles than when jetting takes place in the radial or axial direction.

In a solid fuel burner, if air and fuel gas located on and outside the outer periphery of the fuel nozzle outlet are mixed, ignition and combustion of the fuel particle will start. Accordingly, oxygen concentration is increased by uniform mixing of air on the outer periphery of the fuel nozzle, with the result that ignition and combustion reaction are expedited. This will ensure stable formation of a flame at the fuel nozzle outlet.

To reduce the flow resistance of the fuel jet running through the fuel nozzle, the partition of the additional air nozzle exposed in the fuel nozzle is designed in such a configuration that the sectional area of the flow path is subjected to smooth change. Especially when the partition is so configured as to expand and contract in the circumferential direction of the fuel nozzle, the concentration of the fuel particle on the outer periphery of the fuel nozzle can be maintained.

The wear resistant material is preferably arranged upstream of the partition of the additional air nozzle exposed in the fuel nozzle. The portion upstream of the partition serves to reduce the sectional area of the flow path of the fuel nozzle, thereby discouraging the fuel jet. Accordingly, the fuel particle tends to collide with the partition. Wear can be avoided by the arrangement of the wear resistant material.

Further, the additional air nozzle outlet is preferably arranged where the nozzle forming partition is parallel to the axial direction of the fuel nozzle or where the flow path is extended. Arrangement of the outlet in such a position prevents the fuel particle from counter-flowing out of the additional air nozzle outlet and avoids wear of the outlet.

At least one of the additional air nozzle outlets is preferably arranged on the extreme downstream portion of the additional air nozzle partition. The output provided at the on the extreme downstream portion easily eliminates the fuel particle having entered the additional air nozzle. Prevention of the fuel particle from depositing protects the additional air nozzle against closure and the burner against burnout.

To avoid backfire or burnout caused by ignition of the fuel particle in the fuel nozzle, the distance from the additional air nozzle outlet to the fuel nozzle outlet is preferred to be such that the time for the additional air having a high oxygen concentration to stay inside the fuel nozzle does not exceed the delay time in fuel ignition (approximately 0.1 sec.). Normally, fuel carrier gas runs through the fuel nozzle at a flow rate of 12 through 20 m/s, and thus the distance from the additional air nozzle outlet to the fuel nozzle outlet is less than 1 meter.

The fuel nozzle of the solid fuel burner according to the present invention is preferably equipped with a flow path reducing member that extends the sectional areas of the fuel nozzles after reducing them, sequentially starting from the upstream side of the burner. Reduction in the sectional area of the flow path increases the flow rate of the fuel carrier gas that runs through the fuel nozzle. This configuration enables the fuel nozzle to prevent backfire upstream of the flow path reducing member, even if a flame has been created in the fuel nozzle by instantaneous reduction in the flow rate.

To reduce the flow resistance of the fuel carrier gas, the flow path reducing member is preferably arranged in such a configuration that the sectional area of the flow path undergoes a smooth change, as in the case of a venturi.

If the fuel nozzle incorporates therein a concentrator of a portion that reduces the sectional area of the flow path of the fuel nozzles sequentially starting from the upstream side of the burner, and a portion that extends these areas, the fuel particle is induced to have a velocity component that is oriented toward the outer periphery along the concentrator. Since the fuel particle has a greater inertia than carrier gas, it runs along a skew course on the inner periphery of the partition outside the fuel nozzle to reach the nozzle outlet, with the result that a concentrated fuel jet occurs on the inner periphery of the partition outside the fuel nozzle.

The fuel nozzle of the solid fuel burner according to the present invention is preferably provided with a separator for separating the flow path of the fuel nozzle, and an additional air nozzle is preferably arranged the separated flow path on one side. Installation of the additional air nozzle allows part of the fuel particle to collide with the partition of the additional air to be dispersed. The separator, when provided, will control dispersion of the fuel particle.

Further, the additional air nozzle reduces the sectional area of the fuel nozzle, with the result that flow resistance to fuel jet is increased. Moreover, flow resistance is also provided when additional air is mixed in the form perpendicular to the fuel jet. The flow resistance forces the carrier gas to bypasses the flow path where the additional air nozzle is arranged. However, the fuel particle has a greater straight traveling performance than the carrier gas because of inertia, and thus the reduction in the fuel particle is smaller than that in the flow rate of the carrier gas. As a result, in the flow path on the side of the additional air nozzle, carrier gas is replaced by additional air and oxygen concentration around the fuel particle becomes higher than that of the carrier gas. Thus, subsequent to jetting from the fuel nozzle, ignition and combustion reaction are encouraged by oxygen concentration, with the result that a stable formation of flame is ensured at the fuel nozzle outlet.

Especially when a separator is provided to separate the fuel nozzle into the inner and outer portions, and an additional air nozzle is arranged in the outer flow path, oxygen concentration is increased on the outer periphery of the fuel nozzle and stable formation of a flame can be obtained at the fuel nozzle outlet from its outer edge. Further, when the fuel nozzle incorporates therein a concentrator consisting of a portion that reduces the sectional areas of the fuel nozzles sequentially starting from the upstream side of the burner and a portion that increases the sectional areas, and a separator and additional air nozzle are installed downstream of the concentrator, resulting in higher oxygen concentration and fuel concentration on the outer periphery of the fuel nozzle.

The fuel particle flowing along the inner periphery of the outer-peripheral partition of the fuel nozzle mixes with the air jetted from the air nozzle outside the fuel nozzle in the vicinity of the fuel nozzle outlet. It also provides easy ignition in contact with the high temperature gas of circulating flow formed in the wake flow of the aforementioned flame holder or stabilizer, as described later.

The tip end of the partition between the fuel nozzle and air nozzle is preferably equipped with an obstacle (flame holder) to the solid fuel mixture jetted from the fuel nozzle or to the air flow. Pressure is reduced downstream of the flame holder, and a circulating flow from downstream to upstream sides is formed. The fuel jetted from the fuel nozzle and air nozzle, fuel carrier gas, air and high temperature gas from the downstream side remain in the circulating flow. As a result, temperature is raised in the circulating flow to serve as a source for ignition of the fuel jet. This arrangement ensures stable formation of a flame from the fuel nozzle outlet.

The solid fuel burner according to the present invention is capable of changing the amount of air jetted from the additional air nozzle, in response to the combustion load.

When the combustion load is low, the amount of air jetted from the additional air nozzle is increased. In this case, in the flow path where the fuel nozzle separated by the separator and the additional air nozzle is installed, oxygen concentration is increased by the air jetted from the additional air nozzle. This arrangement encourages fuel combustion reaction and expedites fuel ignition, whereby flame can be formed from close to the fuel nozzle.

When the combustion load is high, the amount of air jetted from the additional air nozzle is reduced. In this case, since the oxygen concentration of the carrier gas is low, fuel combustion reaction makes little headway, causing a lag in fuel ignition. A flame is formed away from the fuel nozzle.

If temperatures of the solid fuel burner and its outer region are too high, combustion ash will deposit on the solid fuel burner structures and furnace wall, and so-called slugging will occur in such a way that deposits grow.

When a flame has detached from the solid fuel burner according to the present invention, temperatures of the solid fuel burner and the furnace wall outside the burner are reduced, whereby slugging is avoided.

If the amount of air jetted from the additional air nozzle is changed in response to signals from the thermometer, radiation temperature gauge and flame detector provided on the solid fuel burner and its surrounding furnace wall, it becomes possible to control the position where the flame of the solid fuel burner is formed.

The aforementioned discussion has referred to the measures taken when the combustion ash of the solid fuel has a low melting point and slugging is likely to occur. The flame of the solid fuel burner can be formed from the fuel nozzle outlet when the combustion ash of the solid fuel has a high melting point, or the thermal load of the furnace is so low that occurrence of slugging does not raise any problem.

In the meantime, if the combustion load is low, the amount of air is preferably adjusted to ensure that the ratio of the total of the amounts of air each supplied from the fuel nozzle of the solid fuel burner and the additional air nozzle, with respect to the mount of air required for complete combustion of the volatile matter in the fuel; namely, the ratio of air to the volatile matter will be in the range from 0.85 through 0.95.

If combustion load is low, stable combustion is difficult to achieve. If the ratio of air to the volatile matter is placed in the range form 0.85 through 0.95, flame temperature will be raised. This will makes it easier to maintain the stable combustion. If the amount of air is changed, it becomes possible to change the flame forming position in the furnace and to adjust the amount of radiation heat from the flame to the solid fuel burner and furnace wall.

Under the high combustion load condition, the thermal load in the furnace is high. Accordingly, the flame is preferably formed away from the solid fuel burner.

The combustion method according to the present invention allows the fuel to catch fire away from the solid fuel burner when heavy load is applied to the combustion apparatus, and the flame is formed at the center of the furnace. To monitor flame under heavy load, it is preferred to monitor the flame at the center of the furnace where the flame of the solid fuel burner is concentrated.

Under light load, the thermal load in the furnace is low therefore, even if the flame is brought close to the solid fuel burner, the temperature of the solid fuel burner or the surrounding furnace wall is lower than under heavy load. This situation is impervious to slugging.

When light load is applied to the combustion apparatus, the fuel catches fire close to the solid fuel burner and a flame is formed. In this case, it may happen that a flame is formed for each solid fuel burner, and flames are each formed separately in the furnace. Further, since the temperature in the furnace is lower than under heavy load, a longer time is required to switch fuel burning. Accordingly, if flame is away from the solid fuel burner, it cannot be consumed before the fuel reaches the furnace outlet. This may cause reduction in combustion efficiency or increase in the amount of unburnt components. To solve this problem, under light load, each flame formed at the outlet of each solid fuel burner is preferably monitored.

In the solid fuel burner according to the present invention, an air nozzle (outside air nozzle) can be arranged outside the fuel nozzle, and the outlet of the outside air nozzle can be equipped with a guide that determines the direction where air is jetted, in such a way that outside air is jetted in the form spread out from the burner center shaft. In this configuration, the fuel spreads along the outside air, and thus the velocity of the fuel having jetting out of the fuel nozzle is reduced, with the result that retention time in the vicinity of the solid fuel burner is increased. This will lead to increased fuel retention time in the furnace, improvement in combustion efficiency and reduction in the amount of unburnt components to be discharged.

When the guide for inducing the jet from the outermost air nozzle is adjusted to attain such an angle that the outside air jet will run along the solid fuel burner or the outside furnace wall, the outside air cools the solid fuel burner or the outside furnace wall, whereby slugging can be reduced.

The combustion apparatus equipped with a plurality of solid fuel burners of the present invention on furnace wall surface includes a coal fired boiler, a peat fired boiler and a biomass (wood) fired boiler.

A thermometer or radiant temperature gauge is installed on the solid fuel burner of the present invention or the furnace wall surface of the solid fuel burner, and the combustion apparatus is operated in such a way as to change the amount of air jetted from the additional air nozzle of the solid fuel burner, based on the signal from these measuring instruments. When this arrangement has been made, control can be made in such a way that flame is formed at an appropriate position in response to the change in the combustion load.

The following procedure is used to determine if the flame is formed at an appropriate position or not: The combustion apparatus is operated in such a way that, when a light load is applied to the combustion apparatus, the tip of the flame in the furnace is formed from the vicinity of the furnace wall surface outside the fuel nozzle outlet; and when a heavy load is applied to the combustion apparatus, the flame is formed in the furnace away from the fuel nozzle outlet by 0.5 meters or more.

When the combustion apparatus is operated under heavy load, the flame at the center in the furnace where the flame of the solid fuel burner of the present invention converges or in the vicinity thereof is monitored by a flame detector or by visual observation. When the combustion apparatus is operated under light load, the flames formed at the outlet of the solid fuel burner of the present invention are each monitored, whereby the combustion apparatus is operated in an appropriate manner.

Referring to FIGS. 1 through 12, the following describes embodiments of a solid fuel burner of the present invention, a combustion method of the solid fuel burner, a combustion apparatus equipped with the solid fuel burner and an operation method of the combustion apparatus.

Embodiment 1

Figure 2:
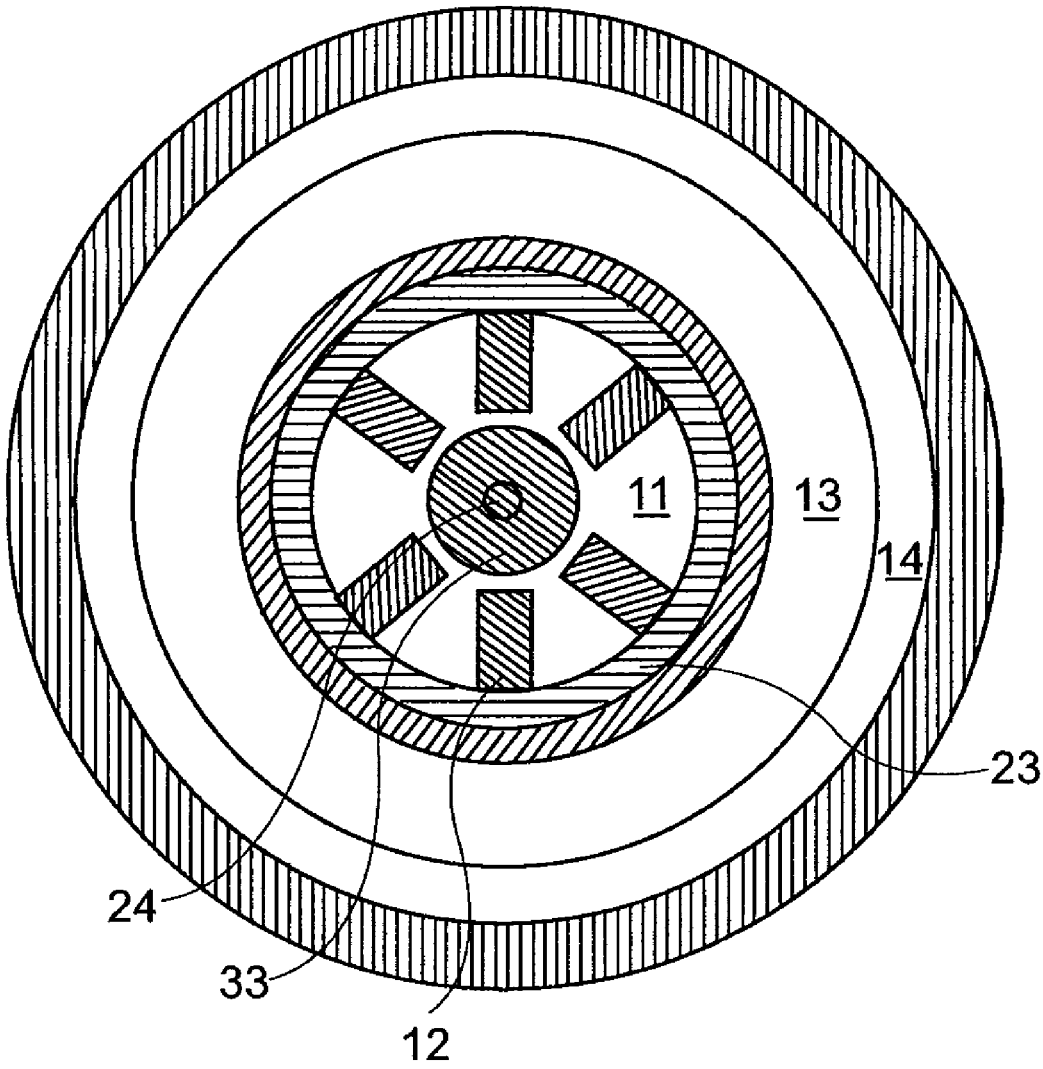
FIG. 2 is a diagram showing the schematic configuration of the solid fuel burner as the first embodiment, as viewed from a furnace.

FIG. 1 is a cross-sectional view representing the configuration of a first embodiment of a solid fuel burner according to the present invention. It shows that, when the solid fuel burner as the first embodiment is used under light load, the flame 20 of the solid fuel burner is formed from the vicinity of a circulating flow 19 downstream of the flame holder or stabilizer 23. FIG. 2 is a diagram showing the schematic configuration of the solid fuel burner as the first embodiment, as viewed from the side of a furnace 41.

The solid fuel burner of the first embodiment is equipped with an oil gun 24 for combustion improvement arranged at the center. A fuel nozzle 11 for jetting the fuel jet, viz., fuel and its carrier gas 16 is arranged around the oil gun 24 for combustion improvement.

The oil gun 24 for combustion improvement provided through the center of the fuel nozzle 11 is used for fuel ignition in starting the solid fuel burner.

A flow path reducing member (venturi) 32 and obstacle (concentrator) 33 are installed in the fuel nozzle 11 from the upstream side. The venturi 32 is configured to smoothly reduce and extend the sectional area of the flow path of the fuel nozzle 11 from the outer periphery. The concentrator 33 is configured to smoothly reduce and extend the sectional area of the flow path of the fuel nozzle 11 from inside.

Outside air nozzles, which are concentric with the fuel nozzle 11 and for jetting air, viz., a secondary air nozzle 13, a tertiary air nozzle 14 and others are arranged outside the fuel nozzle 11.

An obstacle by the name of a flame holder 23 is arranged on the tip outside the fuel nozzle 11, viz., on the furnace outlet side. The flame holder 23 serves as an impediment for the fuel jet from the fuel nozzle 11, viz., the fuel, its carrier gas 16 and secondary air flow 17 flowing through the secondary air nozzle 13. Consequently, the pressure downstream (on the side of the furnace 41) of the flame holder 23 is reduced, and the flow reverse to the fuel jet 16 or secondary air flow 17 is induced in this portion. This reverse flow is called a circulating flow 19.

High temperature gas generated by combustion of the fuel from the downstream side flows into the circulating flow 19 and stays there. This high temperature gas and the fuel in the fuel jet 16 are mixed in the outlet of the solid fuel burner and the temperature of the fuel particle is raised by the radiation heat from the furnace 41, whereby fire is caught.

The secondary air nozzle 13 and tertiary air nozzle 14 are separated from each other by a partition 29 and the tip end of the partition 29 is provided with a guide 25 for jetting in such a way that a certain angle is assigned to the tertiary air flow 18 with respect to the fuel jet 16. If the flow path outlet of the air nozzle (secondary air nozzle 13, tertiary air nozzle 14 and others) on the outer periphery is provided with a guide 25 that guides the air jet direction to be away from the burner center shaft, this guide together with the flame holder 23 is helpful in forming a circulating flow 19.

In the first embodiment, to provide swirling force to the air jetted from the secondary air nozzle 13 and the tertiary air nozzle 14, swirlers 27 and 28 are installed on the secondary air nozzle 13 and the tertiary air nozzle 14.

The burner throat 30 constituting the furnace wall also serves as an outer peripheral wall of the tertiary air nozzle. The furnace wall is equipped with a water pipe 31.

Figure 3:
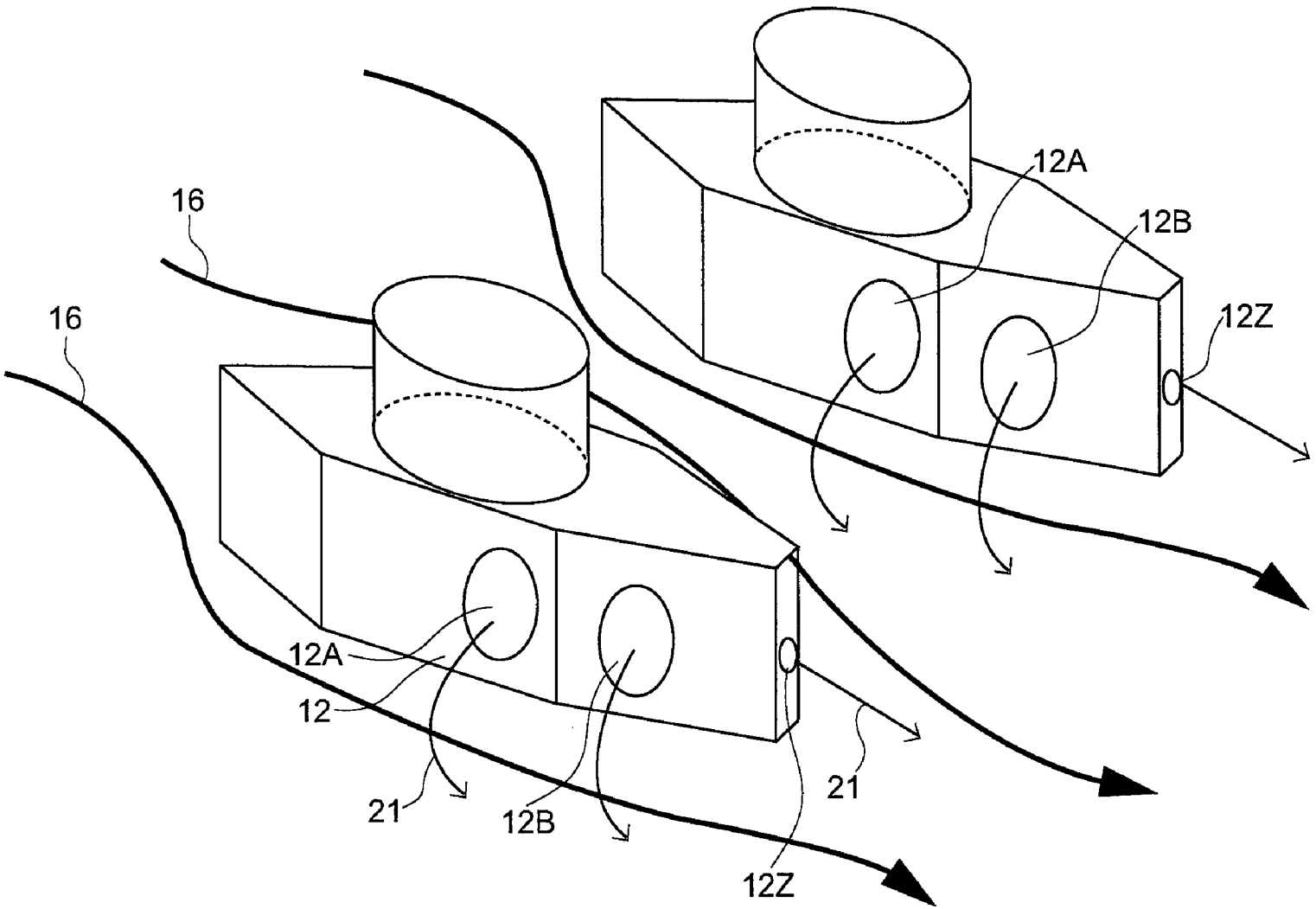
FIG. 3 is a schematic diagram representing the configuration of an additional air nozzle of the solid fuel burner as a first embodiment, and a fuel jet in the fuel nozzle, viz., the flow of the fuel and its carrier gas.

FIG. 3 is a schematic diagram explaining the configuration of the additional air nozzle 12 of the solid fuel burner in the first embodiment, and a fuel jet in the fuel nozzle 11, viz., the flow of the fuel and its carrier gas.

In the solid fuel burner of the first embodiment, a plurality of the additional air nozzles 12 are arranged thereon so that the outlets are in the direction from the outside partition 22 toward the solid fuel burner center axis.

The additional air nozzle 12 is arranged downstream of the concentrator 33 and close to the outside partition 22 of the fuel nozzle 11, with respect to the fuel jet flow 16. The outlets 12A and 12B of the additional air nozzle 12 are located on the side of the partition of the additional air nozzle 12 and additional air is jetted in the circumferential direction of the fuel nozzle 11. The jet 21 of the additional air crosses the fuel jet 16 almost perpendicularly, and is mixed therewith. The backward end of the additional air nozzle 12 forms an outlet 12Z for discharging the fuel particle in a counter flow from the outlets 12A and 12B.

FIG. 3 shows only two additional air nozzles, and indicates the relationship between the fuel jet 16 around the additional air nozzle and the jet 21. In FIG. 3, the direction from left upward to right downward indicates the axial direction of the fuel nozzle the direction from right upward to left downward shows the circumferential direction of the fuel nozzle, and the vertical direction denotes the radial direction of the fuel nozzle. The additional air nozzle 12 is cylindrical on the side of the secondary air nozzle 13 of the partition 22 (not illustrated), and is rectangular parallelepiped on the side of the fuel nozzle 11 where its area is reduced on the sides upstream and downstream of the fuel nozzle 11. The partition 22 (not illustrated) is located where the cylindrical and rectangular parallelepiped forms meet each other.

In FIG. 3, the fuel jet 16 flows from left upward to right downward in the axial direction of the fuel nozzle 11. The additional air jet 21 enters the nozzle from an inlet 12*c* of the cylinder, and is jetted into the fuel nozzle 11 from the outlets 12A and 12B of the rectangular parallelepiped portion.

The additional air jet 21 jetting from the additional air nozzle 12 has a velocity component in the circumferential direction of the fuel nozzle 11 (from right upward to left downward in FIG. 3). This arrangement allows it to cross the fuel jet 16 jetting in the axial direction, almost at right angles with each other. Thus, the difference in the velocity between the fuel particle and air becomes greater than in the case of parallel jetting, whereby mixing progresses. Especially the fuel particle has a greater density than gas; therefore, it is mixed into the additional air jet by inertia.

Further, in the first embodiment, the partition of the additional air nozzle 12 is designed to permit smooth reduction and extension of the sectional area of the flow path of the fuel nozzle. When the outlets 12A, 12B and 12Z of the additional air nozzle 1 are provided on the side of the partition or the downstream reduced portion, it is possible to diminish the chance that the fuel particle flowing through the fuel nozzle enters the additional air nozzle 12. This arrangement minimizes the wear of the outlet portion of the additional air nozzle. Thus, the turbulence of the fuel jet 16 and dispersion of the fuel particle can be reduced by smooth change of the sectional area of the flow path of the additional air nozzle. As shown in FIG. 3, when the partition of the additional air nozzle 12 is extended or reduced in the circumferential direction of the fuel nozzle, the fuel particle colliding with the partition can be prevented from dispersing in the radial direction of the fuel nozzle, and the reduction of the fuel concentration around the fuel nozzle 11 can be diminished.

When the amount of flow of the additional air is increased, the additional air jet 21 is mixed with the fuel jet 16. The outer periphery of the fuel nozzle 11 with the additional air nozzle 12 installed thereon has a greater flow resistance. Consequently, when the amount of flow of the additional air is increased, there is a decrease in the amount of carrier gas flowing through the fuel nozzle 11. In the meantime, since the inertia of the fuel particle is greater than that of gas, the fuel particle flows through the outer periphery, independently of flow resistance. Thus, there is almost no change in the amount of fuel particle.

Such being the case, increase in the amount of additional air will reduce the amount of the carrier gas flowing through the outer periphery of the fuel nozzle 11. Since the carrier gas is replaced with the additional air 21, the dilution rate of oxygen concentration is small, and the oxygen concentration is great, as compared to the case where the carrier gas is merely mixed with the additional air 21.

In FIG. 3, one outlet 12Z is provided on the extreme downstream portion or the downstream end of the partition forming the additional air nozzle 12 as well. The outlet provided on the extreme downstream portion permits easy discharge of the fuel particle having entered the additional air nozzle 12. If the deposition of fuel particle can be avoided, blocking of the additional air nozzle 12 or burnout of the burner can be prevented.

According to the first embodiment, reaction of combustion is encouraged by a high oxygen concentration and fuel concentration in the fuel jet 16 jetted from the fuel nozzle 11, thereby ensuring stable formation of a flame 20 at the fuel nozzle outlet.

The distance from the outlet of the additional air nozzle 12 to the outlet of the fuel nozzle 11 is determined so as to avoid burnout or backfire of the fuel nozzle 11 due to ignition of the fuel in the fuel nozzle 11, which is more likely to occur in the case of higher oxygen concentration. To avoid burnout or backfire of the fuel nozzle 11, the fuel retention time subsequent to mixing of the fuel with the additional air 21 in the fuel nozzle 11 is preferably shorter than the delay time of fuel ignition.

Normally, a rough indication of the delay time is provided by the ignition delay time (about 0.1 sec.) of the gas fuel whose ignition delay time is shorter than that of the pulverized coal. Since the carrier gas flows through the fuel nozzle 11 at the rate of 12 through 20 m/s, the distance from the outlet of the additional air nozzle 12 to the outlet of the fuel nozzle 11 does not exceed 1 meter.

Further, according to the first embodiment, the flow path reducing member (venturi) 32 provided in the fuel nozzle 11 to reduce the area of the flow path is arranged on the outside partition 22 upstream of the fuel nozzle 11. An obstacle (concentrator) 33 for extending the area of the flow path after reducing it once in the fuel nozzle 11 is arranged outside the oil gun 24 at the center of the fuel nozzle 11. The obstacle 33 is arranged downstream of the burner (on the side of the furnace 41), as compared to the flow path reducing member 32.

The venturi 32 causes the fuel carrier gas and fuel particle to induce the velocity component in the direction of the fuel particle center. If the concentrator 33 is arranged downstream of the venturi 32, the fuel carrier gas and fuel particle induce the velocity component in the direction of the outside partition 22 of the fuel nozzle. Since the fuel particle has a greater inertia than the fuel carrier gas, it fails to conform to the flow of the fuel carrier gas. Thus, the fuel particle forms a region of high concentration close to the wall surfaced opposite to the direction where the flow path is changed. Since the velocity component in the direction of the outside partition 22 of the fuel nozzle is induced by the venturi 32 and concentrator 33, a greater proportion of the fuel particle flows along the outside partition 22 of the fuel nozzle 11.

Air jetting from the additional air nozzle 12 flows along the outer periphery of the fuel nozzle 11, and the region having a high fuel concentration and a high oxygen concentration is formed in an uneven state on the inner wall surface of the outside partition 22 of the fuel nozzle 11, with the result that combustion reaction of the fuel particle jetting from the fuel nozzle 11 is encouraged by a high oxygen concentration and fuel concentration, and stable formation of a flame 20 at the fuel nozzle outlet is ensured.

In this case, the fuel jet 16 flowing through the wall surface inside the outside partition 22 of the fuel nozzle 11 tends to mix with the air jetting from the outside air nozzle close to the outlet of the fuel nozzle 11. If it further mixes with the high temperature gas of the circulating flow formed in the wake flow of the flame holder 23, the temperature of the fuel particle will rise and tends to catch fire. This arrangement ensures stable formation of a flame 20 at the fuel nozzle outlet.

When air is jetted from the additional air nozzle 12 in the circumferential direction of the fuel nozzle 11, and air is made to cross the fuel jet 16 almost perpendicularly, then the oxygen concentration is increased in the vicinity of the outside partition 22 of the fuel nozzle 11. This will encourage mixing between the fuel particle and air, so that stable formation of a flame 20 at the fuel nozzle outlet is ensured. This arrangement permits stable combustion to be continued under lighter load than previously.

In the first embodiment, exhaust combustion gas is used as the fuel carrier gas to reduce the oxygen concentration in the fuel jet 16 flowing through the fuel nozzle 11. Such a combustion method is used for combustion of coal, peat and wood having a low coalification rank, represented by brown coal and lignite.

When brown coal and lignite is burnt under heavy load, much volatile matter is contained in the fuel under the conditions where efficient mixing between air and fuel is achieved. This increases the amount of fuel that is burnt in the vicinity of the solid fuel burner, and raises thermal load locally. In this case, the temperatures of the burner structures and furnace wall may be raised by the radiant heat from the flame 20.

When the melting temperature of combustion ash is low, slugging may occur due to deposition and melting of the combustion ash. If the combustion ash deposited by slugging grows, the flow path of the solid fuel burner may be blocked and the stability in the heat-absorbing balance of the furnace wall may be disturbed. In the worst case, the combustion apparatus operation must be stopped. Since the melting temperature of brown coal and lignite in particular is lower than that of the bituminous coal, slugging is likely to occur.

Thus, in the first embodiment, the position where the flame 20 is formed is changed according to the load of the solid fuel burner, and the problem caused by slugging is resolved. To be more specific, flame 20 is formed away from the solid fuel burner under heavy load, whereas flame 20 is formed close to the outlet of the fuel nozzle 11 under light load. Under light load, even if the flame 20 is brought close to the furnace wall and solid fuel burner, the amount of fuel supplied from the solid fuel burner is sufficiently smaller than that under rated load; therefore, the thermal load in the furnace 41 is low and the temperature of the solid fuel burner and its surrounding furnace wall is lower than that under high load. This arrangement prevents slugging from occurring.

In the meantime, under light load, the flame 20 is formed close to the outlet of the fuel nozzle 11, and high temperature gas is made to stay in the circulating flow 19 formed downstream of the flame holder 23 and guide 25. Further, the flow control valve 34 of the additional air nozzle 12 is opened to supply air, and the oxygen concentration in the fuel jet 16 is increased. This increases the combustion velocity over that when the oxygen concentration is low, with the result that ignition of fuel particle is expedited and flame 20 can be formed close to the fuel nozzle 11.

Under heavy load, flame 20 is formed away from the solid fuel burner 42 and the thermal load close to the solid fuel burner is reduced. In the first embodiment, the flow control valve 34 of the additional air nozzle 12 is closed so that the amount of air supplied is smaller than that under light load. In this case, the oxygen concentration in the fuel jet 16 close to the flame holder 23 is lower than that under light load, and the combustion velocity is also reduced. As a result, the temperature of the circulating flow 19 formed upstream of the flame holder 23 is reduced and the amount of radiant heat received by the solid fuel burner structure is also reduced, whereby slugging can be minimized.

Figure 4:
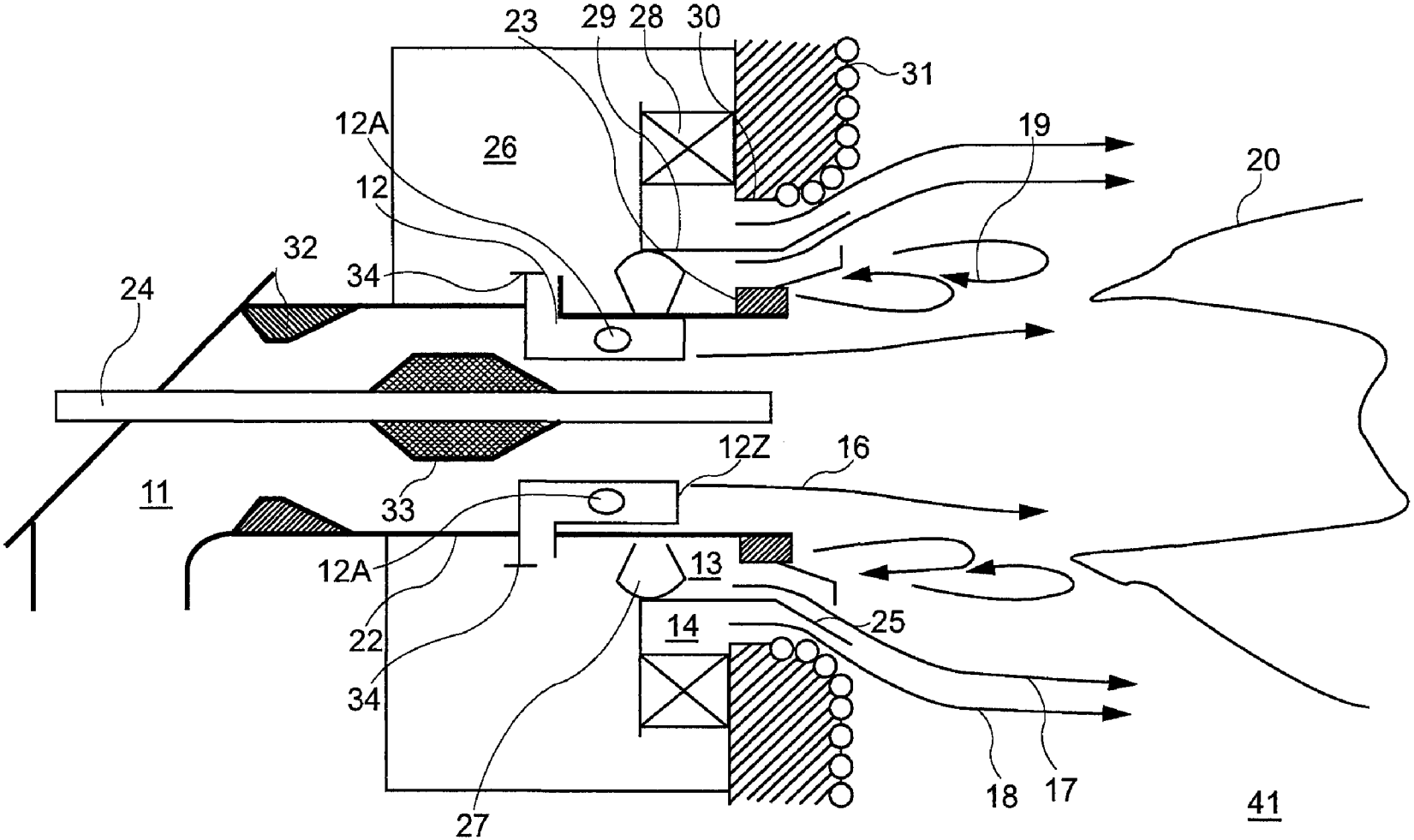
FIG. 4 is a sectional view showing that, when the solid fuel burner of the first embodiment is used under heavy load, the flame of the solid fuel burner is formed away from the tip end of the partition of the fuel nozzle.

FIG. 4 is a sectional view showing that, when the solid fuel burner of the first embodiment is used under heavy load, the flame 20 of the solid fuel burner is formed away from the circulating flow 19 downstream of the flame holder 23.

Figure 5:
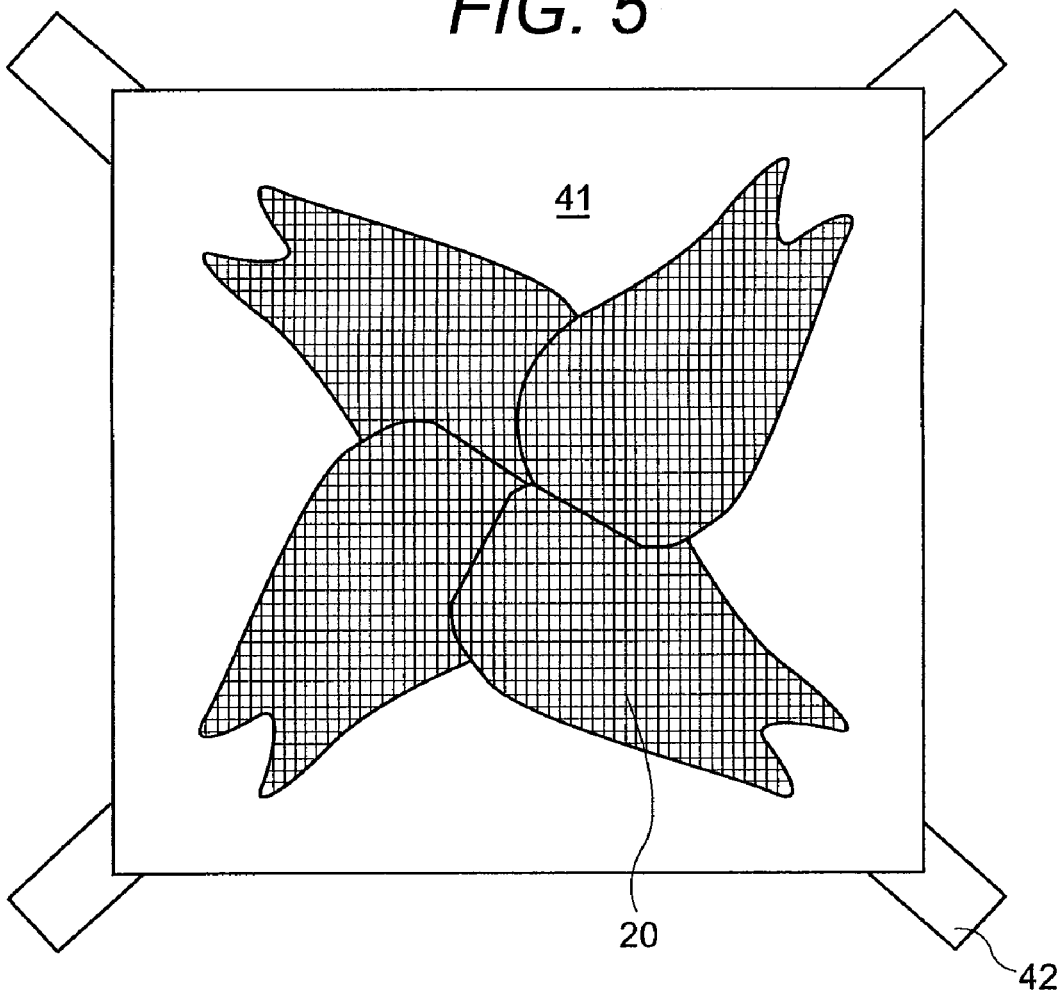
FIG. 5 is a horizontal sectional view showing the structure of the furnace using the solid fuel burner of the first embodiment.

FIG. 5 is a horizontal sectional view showing the structure of the furnace using the solid fuel burner 42 of the first embodiment. When the solid fuel burner 42 is used under heavy load, flames 20 are preferably mixed with each other in the furnace 41 in order to avoid an accidental fire, thereby ensuring stable combustion.

FIG. 5 shows the solid fuel burners 42 arranged at four corners of the furnace wall. Similarly, in the opposing combustion method wherein the solid fuel burners 42 are placed on the opposing faces of the combustion apparatus, if the flame is to be formed away from the solid fuel burner 42, flames 20 are preferably mixed with each other in the furnace 41 in order to avoid an accidental fire, thereby ensuring stable combustion.

In the first embodiment, reference has been made of the measures to be taken when slugging tends to occur due to the solid combustion ash of a low melting point. If the solid combustion ash has a high melting point, or the thermal load of the furnace is low without any possibility of causing slugging, the flame of solid fuel burner 42 may be formed from the outlet of the fuel nozzle 11, as shown in FIG. 1.

When the air supply port is arranged downstream of the solid fuel burner 42 of the furnace, the ratio between the total amount of air supplied from the solid fuel burner 42 and the amount of air required for complete combustion, viz., the amount of air is preferably adjusted to ensure that the burner/air ratio does not exceed 1, in order to reduce the nitrogen oxides (NOx) produced by combustion.

Much of the fuel is mixed with air supplied from the aforementioned nozzle contained in the fuel nozzle 11 and is combusted (1st step). Then the secondary air flow 17 and tertiary air flow 18 are mixed and combustion is carried out (2nd step). Further, when there is an after-air port 49 (FIG. 9) installed to supply air to the furnace 41 downstream of the solid fuel burner 42, the fuel is mixed with the air supplied from this after-air port 49, and complete combustion is carried out (3rd step). The volatile matter in the fuel has a higher combustion velocity than the fixed carbon, and is burnt in the aforementioned first step.

If the burner air ratio does not exceed 1, oxygen is insufficient, but fuel combustion is encouraged and combustion is performed at a high flame temperature. The combustion in the first step allows the fuel to undergo reduced combustion where oxygen is insufficient. The nitrogen oxides (NOx) generated from the nitrogen in the fuel or air are turned into harmless nitrogen, thereby reducing the amount of nitrogen oxides (NOx) discharged from the furnace 41. Since the fuel reacts at a high temperature, the reaction in the second step is promoted to reduce the amount of unburnt contents.

As shown in FIG. 2 viewed from inside the furnace 41, the solid fuel burner 42 of the first embodiment is cylindrical, wherein the fuel nozzle 11, secondary air nozzle 13 and tertiary air nozzle 14 are arranged in a concentric form.

Embodiment 2

Figure 6:
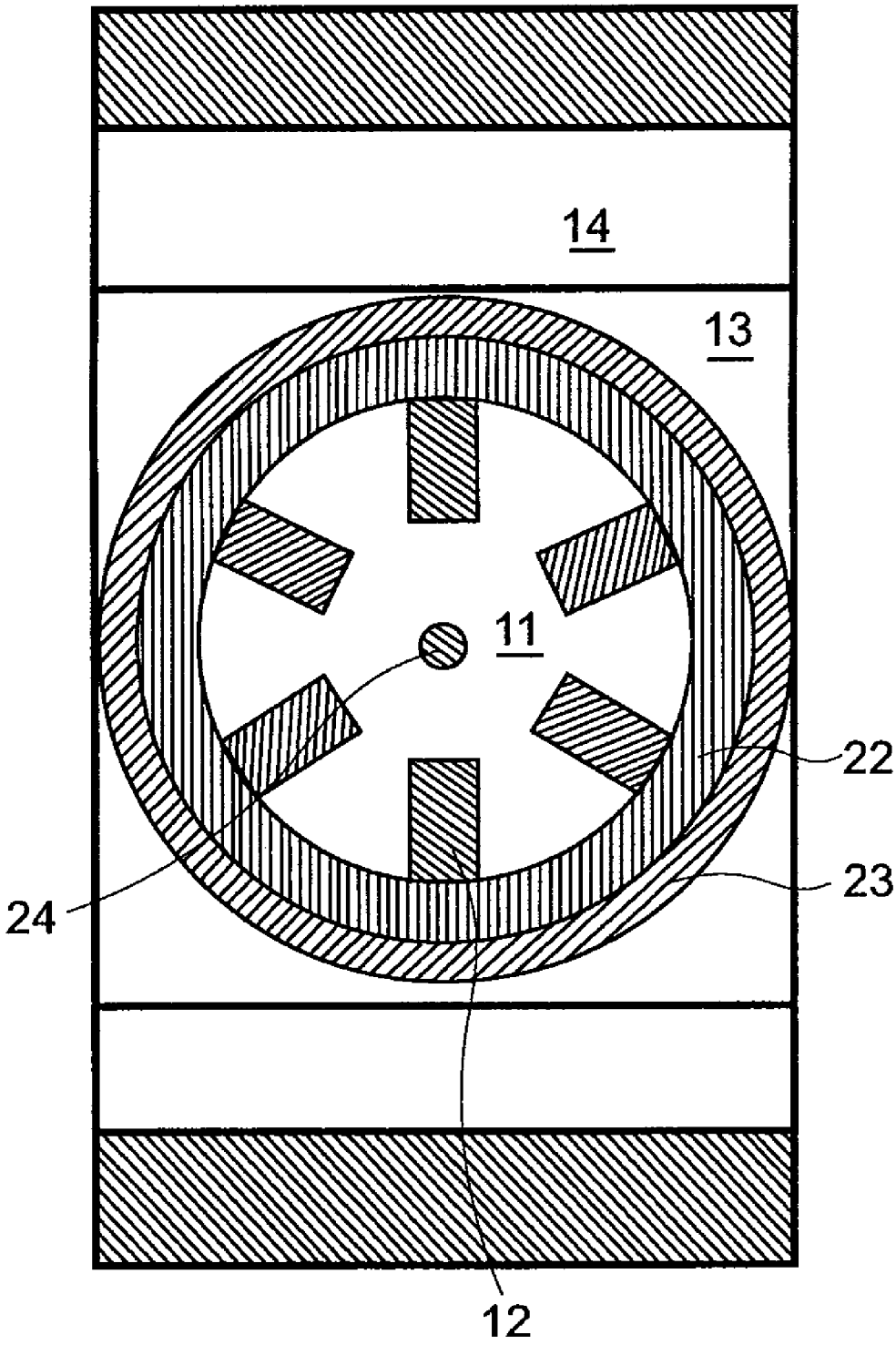
FIG. 6 is a diagram showing the schematic configuration of a second embodiment of the solid fuel burner viewed from the furnace according to the present invention.

FIG. 6 is a diagram showing the schematic configuration of a second embodiment of the solid fuel burner according to the present invention, viewed from the side of the furnace 41.

In FIG. 6, there is no concentrator 33, and at least some parts of the outside air nozzles such as the secondary air nozzle 13 and tertiary air nozzle 14 are installed so as to sandwich the fuel nozzle 11, as compared to the case shown in FIG. 2. It is also possible to arrange such a configuration that the fuel nozzle 11 or the concentrator 33 is rectangular. Further, it is possible to make such arrangements that the outside air nozzles such as the secondary air nozzle 13 and tertiary air nozzle 14 are integrally formed as one nozzle, or the outside air nozzles are separated into three or more components.

Embodiment 3

Figure 7:
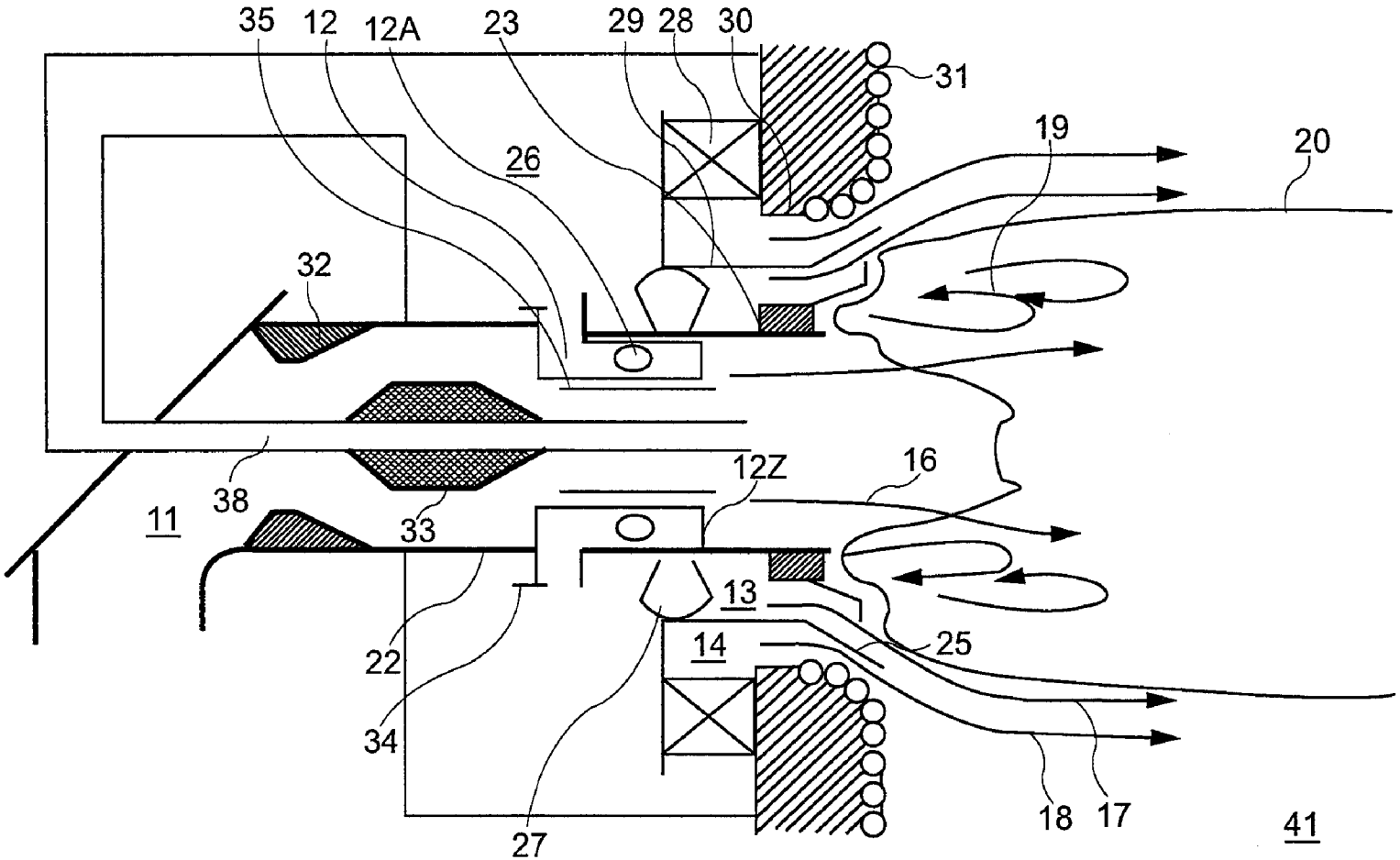
FIG. 7 is a sectional view showing the configuration of a third embodiment of the solid fuel burner according to the present invention, wherein the flame of the solid fuel burner is formed close to the circulating flow downstream of the flame holder when the solid fuel burner is used under light load.

FIG. 7 is a sectional view showing the configuration of a third embodiment of the solid fuel burner according to the present invention, wherein the flame of the solid fuel burner is formed close to the circulating flow downstream of the flame holder when the solid fuel burner is used under light load.

In the third embodiment, an inside air nozzle 38 is provided in the fuel nozzle 11 of the solid fuel burner 42 and is connected with an air box through a pipe. Part of the air supplied to the solid fuel burner is jetted from the inside air nozzle 38.

When air is mixed through the fuel nozzle 11, the mixing between fuel and air is carried out faster than it is mixed only through the outside air nozzles 13 and 14. Further, when a large quantity of air is jetted from the inside air nozzle 38, the flow velocity of the fuel jet 16 is increased to permit the position of fuel ignition to be separated from the solid fuel burner 42.

Thus, when a flame is formed away from the solid fuel burner 42 under heavy load, the amount of air jetted from the additional air nozzle 12 should be decreased and that jetted from the inside air nozzle 38 should be increased.

In FIG. 7, a separator 35 for separating the flow path is provided downstream of the concentrator 33 of the fuel nozzle 11. When the flow path is separated by the separator 35, mixing of the fuel particle, carrier gas and additional air is reduced. This makes it possible to reduce the dispersion of fuel due to the collision of the fuel particle with the additional air nozzle and diffusion of additional air to the vicinity of the center axis.

Embodiment 4

Figure 8:
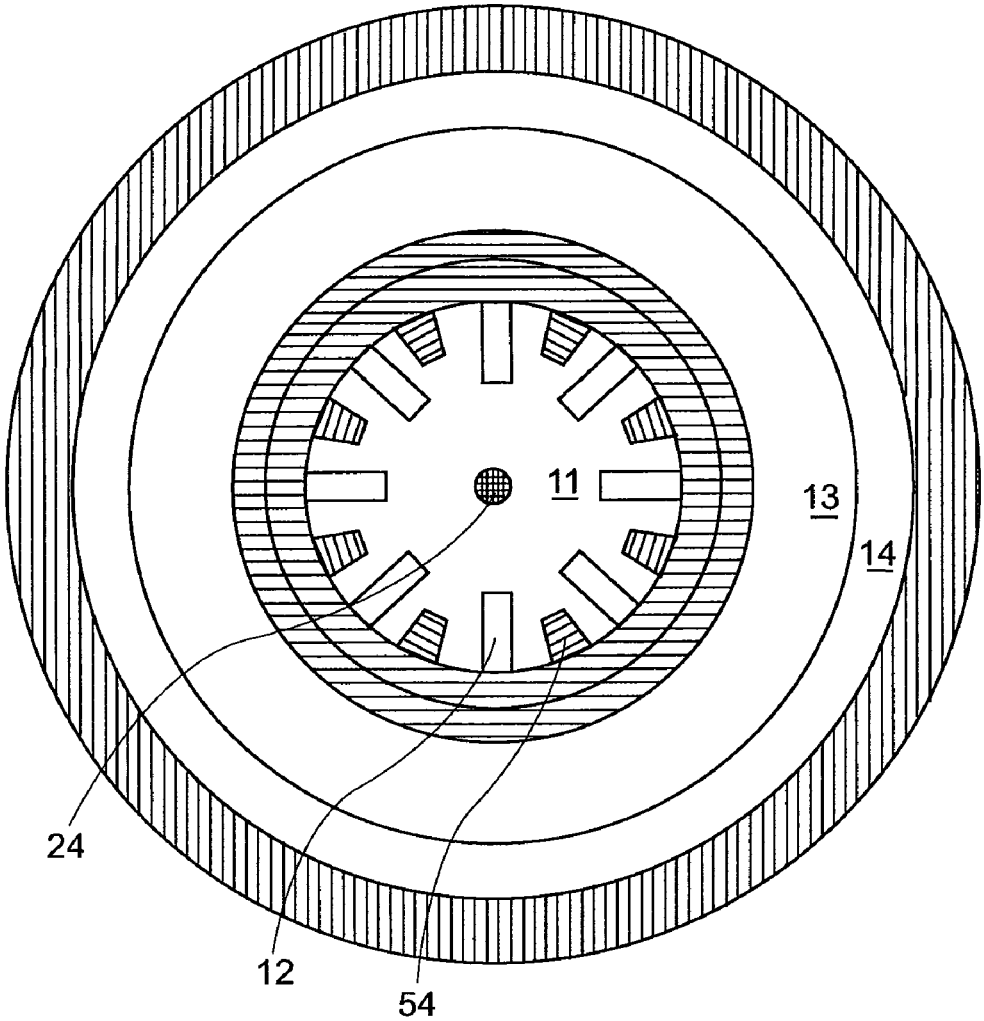
FIG. 8 is a drawing representing the schematic configuration of a fourth embodiment of the solid fuel burner according to the present invention using a toothed flame holder, as viewed from the furnace side.

FIG. 8 is a drawing representing the schematic configuration of a fourth embodiment of the solid fuel burner according to the present invention using a toothed flame holder, as viewed from the furnace side.

In the fourth embodiment, the toothed flame holder 54 with a plate-shaped edge protruding into the outlet of the fuel nozzle 11 is provided to ensure easier ignition of the fuel spreading to the toothed flame holder 54 at the time of combustion. To put it another way, the fuel catches fire downstream of the toothed flame holder 54.

Embodiment 5

Figure 9:
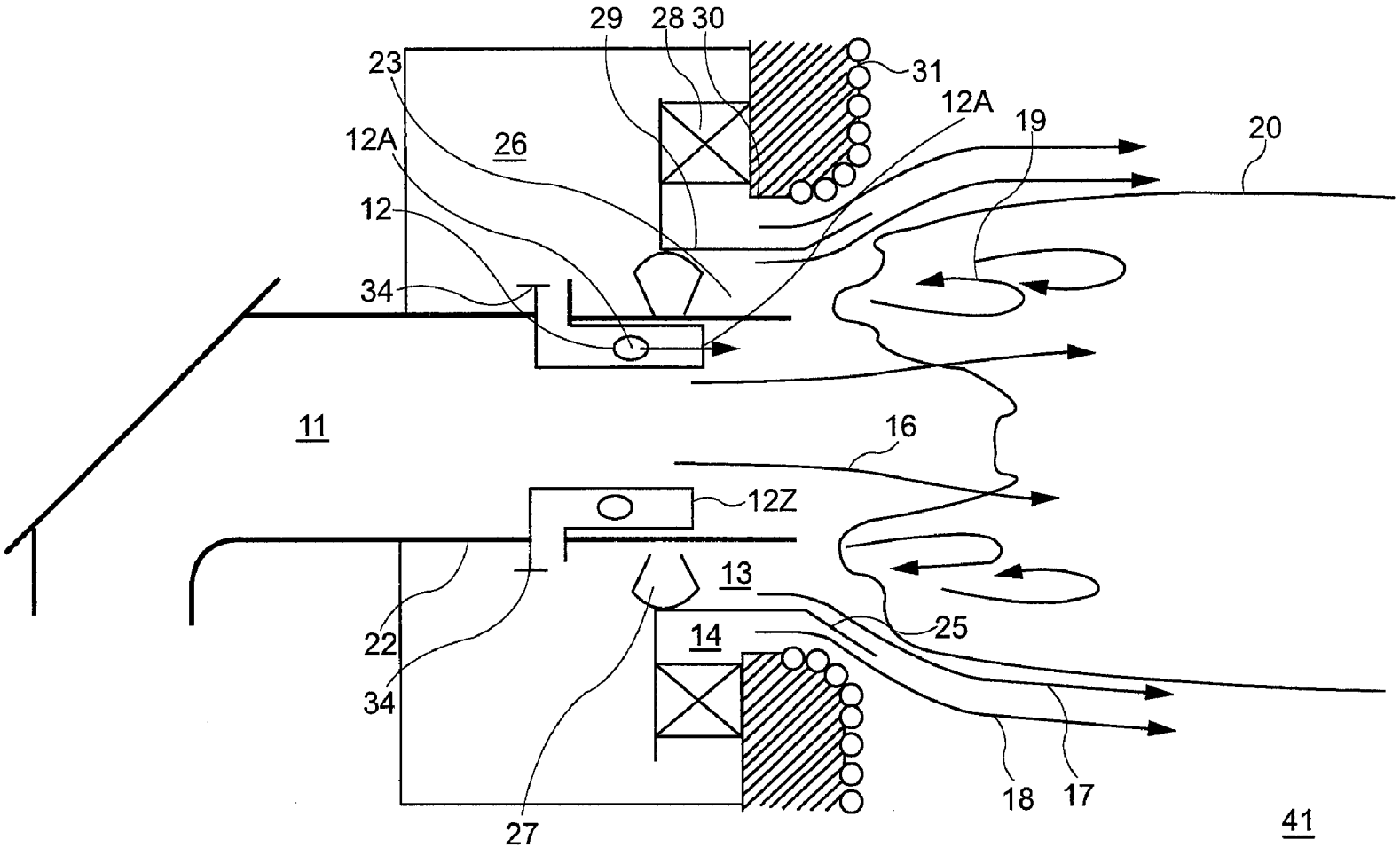
FIG. 9 is a sectional view representing the schematic configuration of a fifth embodiment of the solid fuel burner according to the present invention without a toothed flame holder, wherein the fuel jetted from the solid fuel burner under light load is burnt by a combustion apparatus.

FIG. 9 is a sectional view representing the schematic configuration of a fifth embodiment of the solid fuel burner according to the present invention without a flame holder and concentrator, wherein the fuel jetted from the solid fuel burner under light load is burnt by a combustion apparatus.

The solid fuel burner of the fifth embodiment has no concentrator in the fuel nozzle 11. Further, no flame holder 23 is installed at the tip end of the partition 22 separating the fuel nozzle 11 from the outside air nozzle 13.

In the solid fuel burner shown in FIG. 1, a concentrator 33 is arranged in the fuel nozzle 11. Even in the fifth embodiment where there is no concentrator 33, if the additional air jet 21 is produced in the circumferential direction of the fuel nozzle 11, it crosses the fuel jet flowing through the fuel nozzle 11 almost perpendicularly. The difference in velocity between the fuel particle and air is greater than in the case of parallel jetting. Thus, the mixing between fuel particle and air proceeds, similarly to the case of the first embodiment.

When no flame holder 23 is provided, the effect will be smaller than when a flame holder 23 is arranged, but a circulating flow 19 is formed downstream of the partition 22. If air is mixed with the high temperature gas remaining in the circulating flow 19, the temperature of the fuel particle will rise to facilitate ignition. This arrangement ensures stable formation of a flame 20 at the fuel nozzle outlet.

Figure 10:
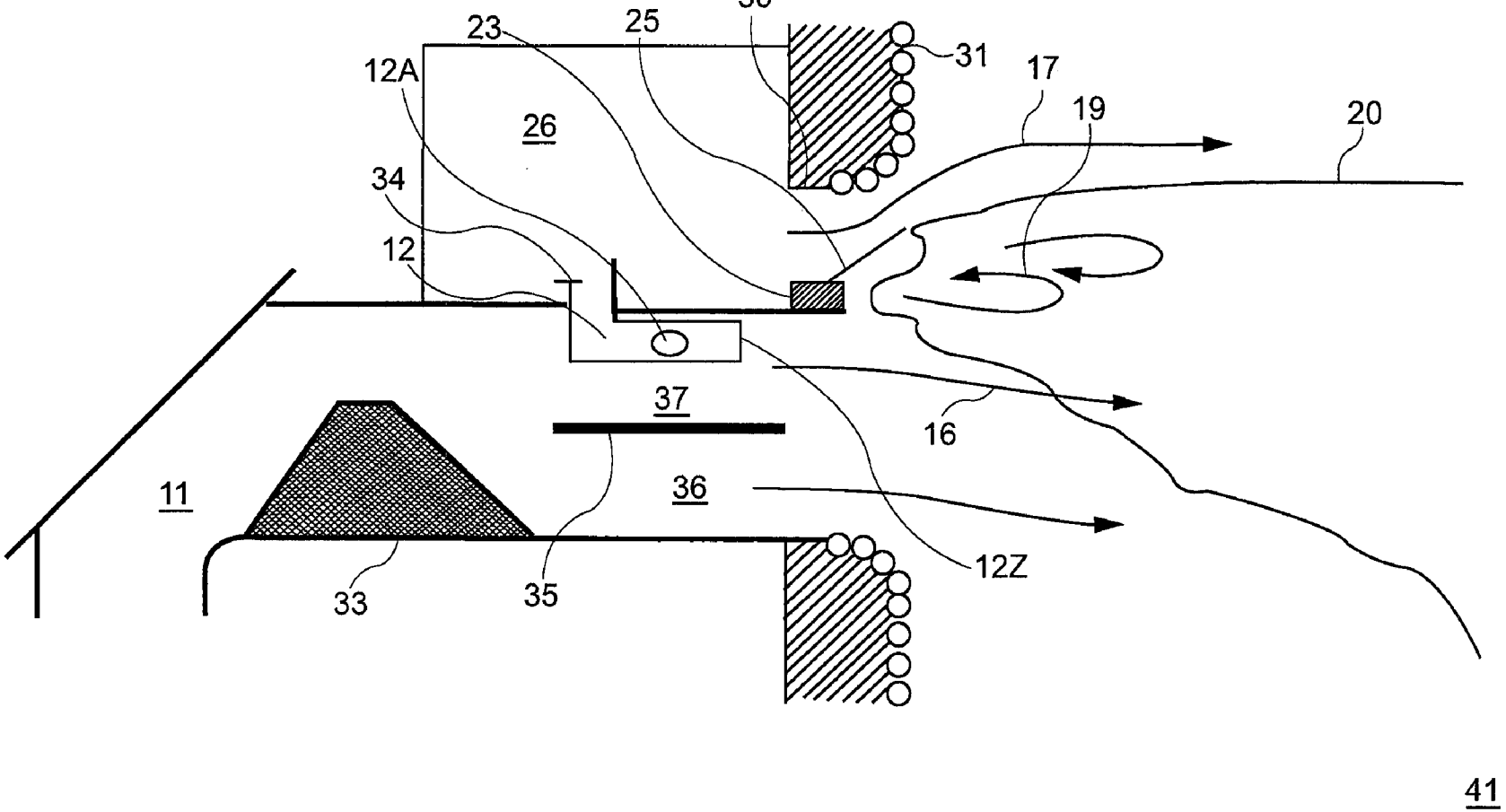
FIG. 10 is a sectional view representing the configuration of the sixth embodiment of the solid fuel burner according to the present invention, wherein the fuel jetted from the solid fuel burner under light load is burnt by the combustion apparatus.

FIG. 10 is a sectional view representing the configuration of a sixth embodiment of the solid fuel burner according to the present invention, wherein the fuel jetted from the solid fuel burner under light load is burnt by the combustion apparatus.

The major difference between the sixth embodiment and the first embodiment is that the fuel nozzle 11 is rectangular and the air nozzle 13 is arranged adjacent to the fuel nozzle 11.

The obstacle (concentrator) 33 and separator 35, in that order as viewed from the upstream side, are arranged in the fuel nozzle 11 and the obstacle 33 is located on the partition opposite to the air nozzle 13 of the fuel nozzle 11. The additional air nozzle 12 is arranged on the side opposite to the concentrator 33 in the fuel nozzle 11. The outlets 12A and 12B of the additional air nozzle 12 are provided on the side of the partition constituting the additional air nozzle.

An obstacle called "flame holder 23" is installed at the tip end of the partition 22 separating the fuel nozzle 11 from the air nozzle 13, viz., on the outlet of the furnace.

Formation of flame 20 is easy downstream of the partition 22 where the air jetted from the air nozzle 13 is mixed with the fuel particle. When the flame holder 23 is arranged downstream of the partition 22, the high temperature combustion gas from inside the furnace 41 resides in the circulating flow 19. This high temperature gas and fuel in the fuel jet 16 are mixed with each other at the outlet of the solid fuel burner 42 and the temperature of the fuel particle is raised by the radiation heat from inside the furnace 41, whereby ignition takes place.

A guide 25 for controlling the jetting in such a way that the air flow 17 has a certain angle with respect to the fuel jet 16 is formed on the side of the air nozzle 13 of the flame holder 23. The guide 25 leads the air jet away from the burner center shaft, with the result that the pressure downstream of the flame holder 23 is reduced to facilitate formation of the circulating flow 19. As shown in the description of the first embodiment, even when the flame holder 23 or guide 25 is not provided, the flame can be formed downstream of the partition 22, although the effect is smaller. In this sense, the flame holder 23 and guide 25 are not indispensable components.

In the sixth embodiment, an additional air nozzle 12 is provided to jet air almost perpendicularly to the fuel jet in the fuel nozzle 11. When the jet 21 of the additional air jetted from the additional air nozzle 12 is jetted almost at almost right angles to the fuel jet, the difference in velocity between the fuel particle and air is greater than in the case of parallel jetting. Thus, the mixing between fuel particle and air proceeds. Especially the fuel particle has a greater density than the gas; therefore, the fuel particle enters the additional air jet to mix therewith.

Further, in the sixth embodiment, the outlet of the additional air nozzle 12 overlaps with the separator 35 with respect to the burner shaft. The additional air 21 is prevented by the separator 35 from jetting against the partition of the concentrator 33, and flows through the air nozzle side flow path 37 of the separator 35.

The air nozzle side flow path 37 of the separator 35, wherein the additional air jet 21 is mixed, provides a greater flow resistance than the flow path 36 on the opposite side. Increase in the amount of additional air will lead to a decrease in the mount of the carrier gas flowing through the flow path 37 on the air nozzle side. In the meantime, since the fuel particle has a greater inertia than the gas, it enters the outside flow path 37, independently of flow resistance. Thus, there is almost no change in the amount of fuel particle.

Accordingly, increase in the amount of the additional air leads to a decrease in the amount of the carrier gas that enters the flow path 37 together with fuel particle. Since the additional air is replaced by the carrier gas, the dilution of oxygen concentration is reduced and oxygen concentration is increased as compared to the case where the carrier gas is merely mixed with the additional air. Further, the separator 35 prevents the fuel particle from being dispersed by the turbulence caused during mixing between the additional air and carrier gas, with the result that oxygen concentration is higher in the air nozzle flow path 37 of the separator 35.

The fuel carrier gas and fuel particle is provided with a velocity component toward the outside partition 22 of the fuel nozzle by the obstacle (concentrator) 33. Since the fuel nozzle has a greater inertia than the fuel carrier gas, it flows along the flow path 37 on the side of the air nozzle of the separator 35 to increase the fuel concentration in this area.

In the sixth embodiment, a separator 35 and concentrator 33 are provided. Even when the additional air nozzle 12 is installed independently, there is a reasonable effect of oxygen concentration rise. The separator 35 and concentrator 33 are re not indispensable components.

Embodiment 7

Figure 11:
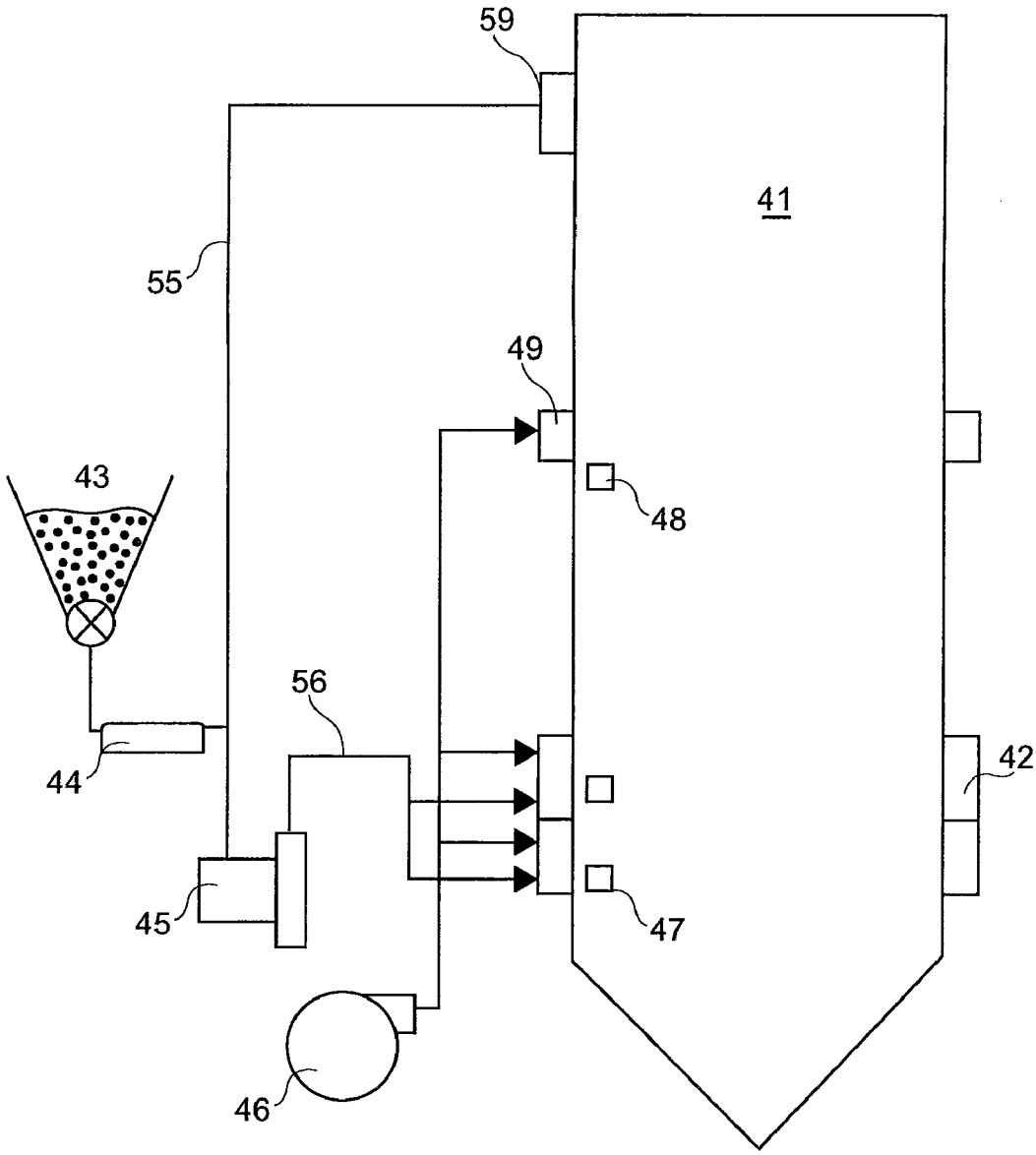
FIG. 11 is a diagram representing the schematic configuration of a combustion apparatus adopting the solid fuel burner according to the present invention.

FIG. 11 is a diagram representing the schematic configuration of a combustion apparatus adopting the solid fuel burner according to the present invention.

In a seventh embodiment, solid fuel burners 42 are provided in two stages in the vertical direction of the combustion apparatus (furnace) 41 and from four corners of the furnace 41 to the center in the horizontal direction. The fuel is supplied to a pulverizer 45 from a fuel hopper 43 through a coal feeder 44. After having been pulverized by the pulverizer 45 the fuel is supplied to the burner 42 through the fuel pipe. In this case, part of the exhaust combustion gas extracted from the top of the furnace 41 is mixed with the fuel in the exhaust combustion gas pipe 55 downstream of the coal feeder 44 and is led into the pulverizer 45.

After the fuel has been mixed with the high temperature combustion gas, the water content of the fuel evaporates. Further, since the oxygen concentration is reduced, the possibility of spontaneous ignition or explosion can be minimized even if the fuel temperature rises when pulverized by the pulverizer 45. In the case of brown coal, the oxygen concentration of carrier gas is 6 through 15 percent. The solid fuel burner 42 and after-air port 49 arranged downstream of the same are supplied with air from the blower 46.

In the seventh embodiment, the two-stage combustion method is employed in which air in the amount smaller than that required for complete combustion of the fuel is supplied from the solid fuel burner 42 and remaining amount of air is supplied from the after-air port 49.

The present invention is also applicable to the single-stage combustion method wherein all the required air is supplied by the solid fuel burner 42, without an after-air port 49 being installed.

Embodiment 8

Figure 12:
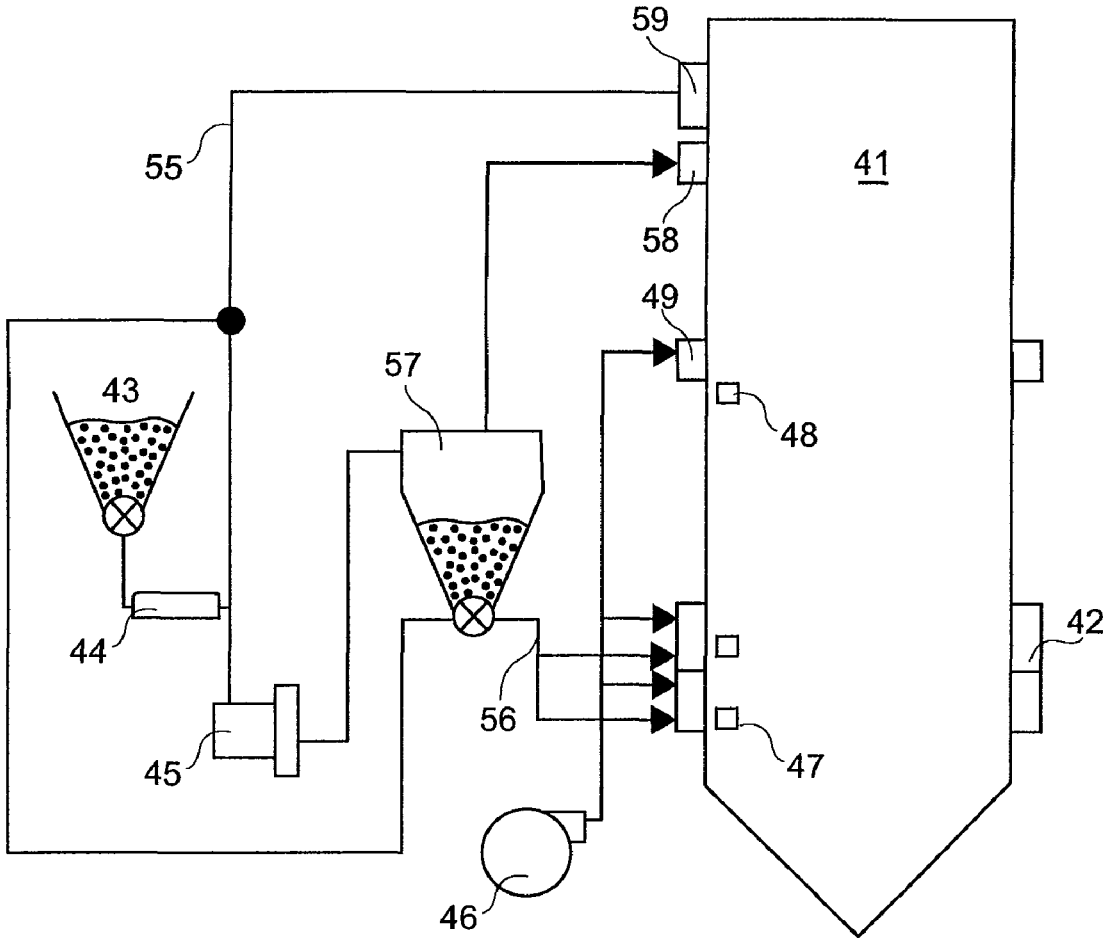
FIG. 12 is a diagram representing the schematic configuration of another combustion apparatus using the solid fuel burner according to the present invention.

FIG. 12 is a diagram representing the schematic configuration of another combustion apparatus using the solid fuel burner according to the present invention.

The seventh embodiment in FIG. 11 is based on the structure wherein temporary fuel storage is not provided between the pulverizer 45 and solid fuel burner 42. By contrast, the eighth embodiment uses the structure wherein a hopper 57 is provided between the pulverizer 45 and solid fuel burner 42.

The eighth embodiment is also applicable to the fuel supply system wherein the carrier gas flowing through a pipe 55 from the pulverizer 45 to the hopper 57 is different from the carrier gas flowing through a fuel pipe 56 from the hopper 57 to the solid fuel burner 42.

In the fuel supply method shown in FIG. 12, the carrier gas whose heat capacity has been increased by evaporation of water content from the fuel particle in the pipe 55 is separated by the hopper 57 and is supplied into the furnace 41 downstream of the solid fuel burner 42 of the furnace 41.

If the carrier gas has been separated as described above, there is a decrease in the amount of water content of the carrier gas supplied to the solid fuel burner 42. This arrangement increases the temperature of the flame 20 formed by the solid fuel burner 42, whereby the amount of nitrogen oxides and unburnt components is reduced.

In the combustion apparatus shown in FIG. 11 or 12, when the solid fuel is burnt under heavy load, the combustion ash will deposit on the solid fuel burner structures and furnace walls. This may cause slugging as a result of growth of the deposit. If there is a high possibility of slugging, the combustion method of the solid fuel burner 42 should be changed in conformity to the combustion load, thereby preventing slugging from occurring.

To be more specific, if flame 20 is formed away from the solid fuel burner 42 under heavy load, the thermal load close to the solid fuel burner 42 can be reduced. Further, under light load, flame 20 is formed from the outlet of the fuel nozzle 11. Flame must be monitored in order to ensure safe operation of the combustion apparatus in such a combustion method.

In the present invention, the combustion method changes in response to the load, and monitoring method is preferably changed, accordingly. To put it another way, under light load, the flame detector 47 must be installed on each solid fuel burner 42, in order to monitor the flame formed for each solid fuel burner 42. Under heavy load, on the other hand, in order to form a flame away from the solid fuel burner 42, a flame detector 48 for monitoring the furnace center must be installed. The signal of the flame detector 47 or 48 is selected in response to each load and combustion method to monitor the flame.

To reduce the slugging on the solid fuel burner structure and wall of the furnace 41 under heavy load, a thermometer or a radiation measuring instrument (not illustrated) is installed on the wall of the furnace 41 or solid fuel burner 42. Then the amount of additional air can be adjusted, based on the signals coming therefrom.

What is claimed is:

1. A solid fuel burner comprising:

a fuel nozzle for jetting a fluid mixture of a solid fuel and its carrier gas into a furnace;

at least one air nozzle, arranged outside the fuel nozzle, for jetting air; and a flame holder provided at a tip end of a partition separating said fuel nozzle and said at least one air nozzle, said flame holder serving as an impediment to a mixture fluid flowing in said fuel nozzle and air flowing in said at least one air nozzle;

wherein at least one additional air nozzle for jetting additional air having a velocity component in the circumferential direction of said fuel nozzle is provided in such a way as to project into said fuel nozzle from the partition of said fuel nozzle toward a solid fuel burner center axis, said at least one additional air nozzle being placed, in the flow path of the fluid mixture as it flows through said fuel nozzle, at a constant cross sectional portion of said flow path upstream of the flame holder;

wherein a partition of said at least one additional air nozzle has a configuration to smoothly reduce the sectional area of the flow path of the fluid mixture and smoothly extend the flow path at a downstream side of the flow path portion with the reduced sectional area;

wherein at least one outlet of said at least one additional air nozzle is placed on a side of the partition of said at least one additional air nozzle;

wherein the fluid mixture and the additional air are jetted from said fuel nozzle after mixing of the fluid mixture and the additional air; and wherein the fuel is burnt after jetting of the fuel from said fuel nozzle.

2. The solid fuel burner according to claim 1, wherein an air jet flow jetted into said fuel nozzle from said additional air nozzle has a velocity component in the circumferential direction of a fluid mixture flow flowing in said fuel nozzle.

3. The solid fuel burner according to claim 2, wherein a venturi, configured to smoothly reduce and extend the sectional area of the flow path of said fuel nozzle from the outer periphery, and a concentrator, configured to smoothly reduce and extend the sectional area of the flow path of said fuel nozzle from the inside, are both arranged upstream of said additional air nozzle.

4. The solid fuel burner according to claim 2, wherein said fuel nozzle incorporates therein a separator for separating the flow path, and the outlet of said additional air nozzle overlaps with said separator, when viewed in the direction perpendicular to the burner axis.

5. The solid fuel burner according to claim 2, wherein:

a venturi, configured to smoothly reduce and extend the sectional area of the flow path of said fuel nozzle from the outer periphery, and a concentrator, configured to smoothly reduce and extend the sectional area of the flow path of said fuel nozzle from the inside, are both provided upstream of said additional air nozzle;

said fuel nozzle incorporates therein a separator for dividing the flow path; and the outlet of said additional air nozzle overlaps with said separator, when viewed in the direction perpendicular to the burner shaft.

6. The solid fuel burner according to claim 5, wherein, of the fuel nozzle flow paths divided by said separator, the flow path on the side where the additional air nozzle is mounted on the tip end upstream of said separator has an area greater than that of the flow path reduced by said concentrator.

7. The solid fuel burner according to claim 2, wherein:

a concentrator configured to smoothly reduce and extend the sectional area of the flow path of said fuel nozzle from the inside is provided upstream of said additional air nozzle;

said fuel nozzle incorporates therein a separator for dividing the flow path; and the outlet of said additional air nozzle overlaps with said separator, when viewed in the direction perpendicular to the burner shaft.

8. The solid fuel burner according to claim 2, wherein said flame holder discourages the flow of the solid fuel jetting from said fuel nozzle and the carrier gas thereof, and the flow of the air jetting from said at least one air nozzle.

9. The solid fuel burner according to claim 1, wherein said at least one additional air nozzle has a configuration to smoothly reduce and extend the sectional area of the flow path of the fluid mixture flowing through said fuel nozzle, a jet outlet formed on the side for jetting the air having a velocity component in the direction perpendicular to the fluid mixture, and a jet outlet formed at a downstream end for jetting the air having a velocity component in the direction parallel to the fluid mixture flowing through said fuel nozzle.

10. The solid fuel burner according to claim 9, wherein a venturi, configured to smoothly reduce and extend the sectional area of the flow path of said fuel nozzle from the outer periphery, and a concentrator, configured to smoothly reduce and extend the sectional area of the flow path of said fuel nozzle from the inside, are both provided upstream of said additional air nozzle.

11. The solid fuel burner according to claim 9, wherein said fuel nozzle incorporates therein a separator for dividing the flow path, and the outlet of said additional air nozzle overlaps with said separator, when viewed in the direction perpendicular to the burner axis.

12. The solid fuel burner according to claim 9, wherein a venturi, configured to smoothly reduce or extend the sectional area of the flow path of said fuel nozzle from the outer periphery, and a concentrator, configured to smoothly reduce and extend the sectional area of the flow path of said fuel nozzle from the inside, are both provided upstream of said additional air nozzle;

said fuel nozzle incorporates therein a separator for dividing the flow path; and the outlet of said additional air nozzle overlaps with said separator, when viewed in the direction perpendicular to the burner shaft.

13. The solid fuel burner according to claim 9, wherein, of the fuel nozzle flow paths divided by said separator, the flow path on the side where the additional air nozzle is mounted on the tip end upstream of said separator has an area greater than that of the flow path reduced by said concentrator.

14. The solid fuel burner according to claim 9, wherein:

a concentrator configured to smoothly reduce and extend the sectional area of the flow path of said fuel nozzle from the inside is provided upstream of said additional air nozzle;

said fuel nozzle incorporates therein a separator for dividing the flow path; and the outlet of said additional air nozzle overlaps with said separator, when viewed in the direction perpendicular to the burner shaft.

15. The solid fuel burner according to claim 9, wherein said flame holder discourages the flow of the solid fuel jetting from said fuel nozzle and the carrier gas thereof, and the flow of the air jetting from said at least one air nozzle.

16. The solid fuel burner according to claim 9, wherein said flame holder is a toothed flame holder that discourages the flow of the solid fuel jetting from said fuel nozzle and the carrier gas thereof, and the flow of the air jetting from said at least one air nozzle.

17. The solid fuel burner according to claim 1, wherein a portion, exposed inside said fuel nozzle, of a partition forming said additional air nozzle has a rectangular parallelepiped form that is narrowed toward both upstream and downstream sides of said fuel nozzle, and at least one outlet of said additional air nozzle is provided on a side portion of said rectangular parallelepiped portion.

18. A solid fuel burner comprising:

a fuel nozzle for jetting a fluid mixture of a solid fuel and its carrier gas that has an oxygen concentration lower than air into a furnace;

at least one air nozzle, arranged outside the fuel nozzle, for jetting air; and a flame holder provided at a tip end of a partition separating said fuel nozzle and said at least one air nozzle, said flame holder serving as an impediment to a mixture fluid flowing in said fuel nozzle and air flowing in said at least one air nozzle;

wherein at least one additional nozzle for jetting a gas for combustion higher in oxygen concentration than said carrier gas and having a velocity component in the circumferential direction of said fuel nozzle is provided in such a way as to project into said fuel nozzle from the partition of said fuel nozzle toward a solid fuel burner center axis, said at least one additional nozzle being placed, in the flow path of the fluid mixture as it flows through said nozzle, at a constant cross sectional portion of said flow path upstream of said flame holder;

wherein a partition of said at least one additional nozzle has a configuration to smoothly reduce the sectional area of the flow path of the fluid mixture and smoothly extend the flow path at a downstream side of the flow path portion with the reduced sectional area;

wherein at least one outlet of said at least one additional nozzle is placed on a side of the partition of said at least one additional nozzle; and wherein the fluid mixture and the gas for combustion are jetted from said fuel nozzle after mixing of the fluid mixture and the gas for combustion, and the fuel is burnt after jetting of the fuel from said fuel nozzle.

19. A combustion apparatus having a solid fuel burner, said solid fuel burner comprising:

a fuel nozzle for jetting a fluid mixture of a solid fuel and its carrier gas that has an oxygen concentration lower than air into a furnace;

at least one air nozzle, arranged outside the fuel nozzle, for jetting air; and a flame holder provided at a tip end of a partition separating said fuel nozzle and said at least one air nozzle, said flame holder serving as an impediment to a mixture fluid flowing in said fluid nozzle and air flowing in said at least one air nozzle;

wherein at least one additional nozzle for jetting a gas for combustion higher in oxygen concentration than said carrier gas and having a velocity component in the circumferential direction of said fuel nozzle is provided in such a way as to project into said fuel nozzle from the partition of said fuel nozzle toward a solid fuel burner center axis, said at least one additional nozzle being placed, in the flow path of the fluid mixture as it flows through said fuel nozzle, at a constant cross sectional portion of said flow path upstream of said flame holder;

wherein a partition of said at least one additional nozzle has a configuration to smoothly reduce the sectional area of the flow path of the fluid mixture and smoothly extend the flow path at a downstream side of the flow path portion with the reduced sectional area;

wherein at least one outlet of said at least one additional nozzle is placed on a side of the partition of said at least one additional nozzle; and wherein the fluid mixture and the gas for combustion are jetted from said fuel nozzle after mixing of the fluid mixture and the gas for combustion, and the fuel is burnt after jetting of the fuel from said fuel nozzle.

* * * * *